US006722009B2

(12) United States Patent
Kojima et al.

(10) Patent No.: US 6,722,009 B2
(45) Date of Patent: Apr. 20, 2004

(54) METALLIC SHEET HYDROFORMING METHOD, FORMING DIE, AND FORMED PART

(75) Inventors: Masayasu Kojima, Takarazuka (JP); Mitsutoshi Uchida, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/141,074

(22) Filed: May 9, 2002

(65) Prior Publication Data

US 2002/0166222 A1 Nov. 14, 2002

(30) Foreign Application Priority Data

May 10, 2001 (JP) ..... 2001-139848
Apr. 11, 2002 (JP) ..... 2002-108901

(51) Int. Cl.[7] ..... B23P 17/00

(52) U.S. Cl. ..... 29/421.1; 29/890.044; 29/463; 29/524

(58) Field of Search ..... 29/421.1, 897, 29/463, 897.2, 423, 514, 509, 524, 890.039, 890.044; 72/58, 61, 57, 55, 60, 62; 228/157, 160, 161, 193

(56) References Cited

U.S. PATENT DOCUMENTS

| | | | | |
|---|---|---|---|---|
| 3,024,525 A | | 3/1962 | Wisberger | |
| 3,807,009 A | | 4/1974 | Ostbo | |
| 3,927,817 A | * | 12/1975 | Hamilton et al. | 228/157 |
| 4,331,284 A | * | 5/1982 | Schulz et al. | 228/157 |
| 4,361,262 A | * | 11/1982 | Israeli | 228/118 |
| 4,534,196 A | | 8/1985 | Kiyoto et al. | |
| 5,372,026 A | * | 12/1994 | Roper | 72/60 |
| 5,533,372 A | * | 7/1996 | Roper et al. | 72/60 |
| 5,692,406 A | | 12/1997 | Yasui | |
| 5,737,954 A | | 4/1998 | Yasui | |
| 5,816,089 A | * | 10/1998 | Marando | 72/55 |
| 6,055,715 A | * | 5/2000 | Ni et al. | 29/421.1 |
| 6,098,262 A | | 8/2000 | Thoms et al. | |
| 6,418,607 B1 | * | 7/2002 | Seifert et al. | 29/421.1 |

FOREIGN PATENT DOCUMENTS

| | | |
|---|---|---|
| DE | 4427140 | 10/1995 |
| DE | 19535870 | 2/1997 |
| EP | 0589370 | 3/1994 |
| JP | 47-33864 | 11/1972 |
| JP | 63-295029 | 12/1988 |
| JP | 08-174091 | 7/1996 |
| JP | 09-029329 | 2/1997 |
| JP | 11-347643 | 12/1999 |

* cited by examiner

*Primary Examiner*—Charles T. Jordan
*Assistant Examiner*—Trinh Nguyen
(74) *Attorney, Agent, or Firm*—Clark & Brody

(57) ABSTRACT

A sheet hydroforming method is disclosed wherein two stacked metallic sheets are clamped between a pair of upper and lower dies 10, 11 and a fluid is introduced and pressurized between mating surfaces of the metallic sheets, causing the metallic sheets to bulge into a space defined by die cavities 10*b* and 11*b*. A thru-hole 11*d* for introducing the fluid is formed in one of the dies so as to lead to a holding surface of the die, while a pierced hole for introducing the fluid is formed in one of the metallic sheets in a portion of the one metallic sheet which portion is in contact with a holding surface 10*a* (10*b*) of one of the dies, the pierced hole being positioned with the thru-hole 11*d*, then the fluid is introduced in a pressurized state between mating surfaces of the metallic sheets from the thru-hole through the pierced hole, thereby causing the metallic sheets to bulge. According to this method, a pressurized fluid can be introduced between the mating surfaces of blanks easily without leakage of the fluid. Not only the efficiency of the sheet hydroforming method but also the dent resistance of a formed part can be improved.

16 Claims, 23 Drawing Sheets

PRIOR ART

METALLIC SHEET HYDROFORMING METHOD, FORMING DIE, AND FORMED PART

FIELD OF THE INVENTION

The present invention relates to a metallic sheet hydroforming method using metallic sheets as blanks, as well as a forming die used in the method and a formed part on workpiece.

DESCRIPTION OF THE PRIOR ART

A sheet hydroforming method is known in which peripheral portions of two metallic sheets (hereinafter referred to also as "blanks") are bonded together, then a fluid is introduced between the blanks, followed by the application of pressure of the fluid, causing the blanks to be bulged.

FIGS. 1A, 1B, 1C, and 1D illustrate a forming method described in Japanese Patent Application Laid Open No. 47-033864. FIG. 1A is a perspective view of two blanks which are each in a ring shape, FIG. 1B is a sectional view of a die portion before a forming work in which two blanks bonded together at their peripheral portions are set between upper and lower dies, FIG. 1C is a sectional view of the die portion in a completed state of sheet hydroforming, and FIG. 1D is a perspective view of a bent tubular part obtained by cutting a formed part on workpiece crosswise.

The blanks shown in FIG. 1A are in a state before being subjected to peripheral bonding into a single blank. The blanks are two ring-like blanks 100 and 102. A pipe-like nozzle 101 is bonded, for example by welding, to the position of a thru-hole formed in a planar portion of the blank 100. The blanks 100 and 102 are put one on the other and are bonded together for example by welding throughout the whole inner and outer peripheries thereof to afford a workpiece ("bonded blank" hereinafter).

First, as shown in FIG. 1B, the bonded blank, indicated at 103, is set on a lower die 104, then an upper die 105 is brought down from above by means of a drive unit (not shown), an outer peripheral portion 103*a* and an inner peripheral portion 103*b* of the bonded blank are pressed and sandwiched in between the upper and lower dies, and the nozzle and a pipe 106 are connected together through a thru-hole 105*b* formed in the upper die. Die cavities 104*a* and 105*a* having an inner contour shape which is the same as an outer contour shape of product are formed in the lower die 104 and upper die 105, respectively. Then, a fluid is introduced between mating surfaces of the bonded blank from a pump (not shown) through the pipe and nozzle, followed by the application of pressure, causing the bonded blank to bulge.

The full-circled bonding of the blanks 100 and 102 is for the purpose of preventing the leakage of fluid from the mating surfaces of the bonded blank.

As shown in FIG. 1C, by raising the pressure of the fluid 107, the metallic sheets bulge into contact with inner walls of the die cavities 104*a* and 105*a* and the forming work is completed. Thereafter, the internal fluid pressure is decreased, the pipe is pulled out, the upper die is raised, a ring-like hollow shell 108 is taken out, and the interior fluid is discharged from the nozzle. The formed part on workpiece is cut crosswise into a desired product size, affording a bent tubular part 109.

The above method brings about the following advantages in comparison with a method wherein upper and lower parts are manufactured separately by a press stamping method for example and thereafter both are bonded and assembled together by, say, welding.

The first advantage is that the bonding is easy because the blanks are bonded in a flat state. In case of bonding upper and lower stamped parts, it is necessary to use a jig for shape correction and alignment with respect to each of elastically recovered stamped parts, and the number of working steps increases.

The second advantage is that since the working is done using upper and lower dies and fluid, the tool expenses are low in comparison with the press stamping method.

The third advantage is that since a stretch formed portion is created by forming with a tensile stress based on a fluid pressure, a problem such as body wrinkling, which is often observed in press stamping, is difficult to occur.

These advantages are also true of the following prior art examples.

FIGS. 2A and 2B are diagrams for explaining a forming method disclosed in Japanese Patent Application Laid Open No. 63-295029. FIG. 2A is a perspective view of a bonded blank before forming and FIG. 2B is a perspective view of a formed part on workpiece.

In this method, as shown in FIG. 2A, two blanks 110 and 111, which are fabricated in a developed shape of a desired product by a press punching method for example, are put one on the other and outer peripheral edges 112 of their mating surfaces are bonded together by a laser welding method for example to afford a bonded blank 113. The bonded blank 113 is then set within upper and lower dies and pressurized fluid is introduced between the mating surfaces from a suitable bonded blank opening, causing the blank to bulge. As shown in FIG. 2B, the resulting formed part is an engine manifold part 117 having a welded line 116, in which manifold portions 114 and a trunk portion 115 are cut at their end portions.

FIGS. 3A, 3B, 3C, 3D, and 3E are diagrams explanatory of a forming method disclosed in Japanese Patent Application Laid Open No. 09-029329. FIG. 3A shows blanks 120 and 121 before bonding, the blanks 120 and 121 being formed with half conical recesses 120*a* and 121*a* on flange, respectively, by press stamping. FIG. 3B shows a bonded blank 123 obtained by superimposing blanks 120 and 121 one on the other and bonding the two by, say, laser welding along a continuous welded line 123*b* except a conical inlet 123*a*. FIG. 3C shows a state in which a peripheral portion of the bonded blank 123 is held grippingly by lower die 125 and upper die 126 attached to a press machine (not shown), then a conical head 127*b* of an injection nozzle 127 is inserted into the inlet 123 by means of a drive unit (not shown) and is pushed against half conical recesses 125*b* and 126*b* on die surfaces. Then, pressurized fluid is injected between the blank mating surfaces from a pump (not shown) through an intra-nozzle channel 127*a*, causing die cavities 125*a* and 126*a* having the same inner contour shape as an outer contour shape of product to bulge. With this bulging motion, a flange 123*c* which has been held grippingly by the dies 125 and 126 moves gradually toward the die cavities 125*a* and 126*a* except the portion near the inlet. FIG. 3D shows a completely bulged state in which the blanks were brought into contact with inner walls of the die cavities 125*a* and 126*a* by increasing the pressure of fluid 128. Thereafter, the pressure of the fluid is decreased and the fluid is discharged from the inlet 123*a* to afford a formed part 129. FIG. 3E shows an example of a tubular part 129 obtained by cutting off the portion located outside the welded line 123*b* and also cutting off both ends of the stretch formed portion of workpiece.

In the above sheet hydroforming methods, the following problems are encountered in injecting the pressurized fluid between the mating surfaces of blanks.

In the forming method shown in FIGS. 1A, 1B, 1C, and 1D it is necessary that the nozzle be bonded to the associated blank while assuming a position which permits smooth insertion of the nozzle into the thru-hole formed in the upper die as the bulging motion proceeds. This requirement may not be satisfied in some particular sectional shape of product. Besides, since connection and disconnection between the nozzle and the pipe are troublesome, the productivity is low and automation is difficult.

In the forming method disclosed in Japanese Patent Application Laid Open No. 63-295029, which is illustrated in FIGS. 2A and 2B, there is made no reference to a pressurized fluid injecting method.

In the forming method illustrated in FIGS. 3A, 3B, 3C, 3D, and 3E there arises a problem of how to seal the pressurized fluid between the bonded blank inlet and the conical portion of the nozzle.

FIG. 4 is a front view showing the inlet 123*a* as seen in the direction of arrow A in FIG. 3B. Since bent portions 130 are rounded at a radius at least equal to the blank thickness, there are formed tapered grooves 131 and hence it is necessary to prevent the leakage of pressurized fluid from the grooves 131. But in Japanese Patent Application Laid Open No. 09-029329 there is found no explanation about a method to be taken for the prevention of such fluid leakage.

As noted above, as to the sheet hydroforming in which a pressurized fluid in injected between the mating surfaces of the bonded blank, working methods are disclosed in the prior art references, but a concrete pressurized fluid injecting method superior in utility is not disclosed therein.

A description will now be given about dent resistance. As to shallow-bottom panel parts (also referred to simply as "panel parts" hereinafter) formed by metallic sheets, typical of which are automobile door panel, bonnet, and trunk lid, it is required for them to possess a property such that a dent is difficult to remain after the application of a local external force to the panel surface, i.e., dent resistance. For example, in the case of the automobile door panel, if a dent defect ("dent" hereinafter) occurs due to pressing with a thumb near a door handle at the time of opening or closing of the door concerned, the appearance of the door is impaired.

Also in the case of the automobile bonnet and trunk lid, their appearance is impaired by the dent caused by pressing with palms when they are closed. Not only the pressing with fingers and palms, but also the collision of a flying stone with a panel part during vehicular running may form a dent. Dent resistance is a subject to be attained not only in such vehicular panel parts as mentioned above but also in panel parts of home electric appliances such as the refrigerator door.

FIGS. 5A, 5B, and 5C show an example of a method for evaluating quantitatively how dent is difficult to occur, i.e., dent resistance. FIG. 5A is a sectional view showing a state in which a load P is imposed on a panel surface 200 of a panel part 201 through an indentor 150 having a semispherical tip. FIG. 5B shows a load-removed state, in which such a dent 151 of depth d as shown in FIG. 5C is formed in a loaded portion B.

The larger a critical load P of inducing a dent of depth d (e.g., 0.02 mm) which poses a problem as product, the higher the dent resistance. The critical load P is designated a dent resistance load. It goes without saying that the dent resistance load should be measured at unified test conditions because the dent resistance load is influenced by the radius of curvature of the indentor tip or by the hardness of the indentor in case of the indentor being an elastic indentor.

Further, dent resistance is influenced by the thickness of a panel part and the yield strength of the material used. Dent resistance becomes lower with a decrease of the panel thickness and yield strength. Therefore, for reducing the panel part thickness to reduce the weight of the panel part, it is necessary to increase the strength of the panel surface so as to prevent deterioration of the dent resistance.

FIG. 6 illustrates a method of sampling a tensile specimen from a panel surface. The aforesaid yield strength indicates a yield strength determined using a tensile specimen 202 cut out from a portion of the panel part 201 which portion involves the problem of dent resistance, as shown in FIG. 6.

FIG. 7 schematically illustrates a relation between a stretch strain (e) and a tensile stress ($\sigma$) (tensile load/original sectional area of specimen) in a tension test for a sheet blank and also in a tension test ("panel tension test" hereinafter) using the specimen sampled from the panel part, i.e., a stress-strain diagram.

In the same figure, a curve OAB represents the result of the blank tension test, in which the point A is a yield point, while a curve O'A'B is a stress-strain diagram in the panel tension test, with point A' being a yield point. A clear difference between the two curves is a difference between the stress at point A and the stress at point A'. A yield point stress ($\sigma$A') ("panel surface yield point stress" hereinafter) in the panel tension test is larger than a yield point stress ($\sigma$A) ("blank yield point stress" hereinafter) in the blank tension test. This is due to the influence of work hardening caused by the imposition of a permanent strain on point O' in the panel manufacture.

Since a dent which causes a problem in the appearance beauty is formed by very small plastic deformation of a panel part under the action of a local external force, it is presumed that the larger the panel surface yield point stress ($\sigma$A'), the more improved the dent resistance.

The panel parts referred to previously have heretofore been manufactured by press stamping of sheet metal.

FIGS. 8A, 8B, and 8C illustrate tools used in press stamping, a state of stamping, and an example of a formed part. FIG. 8A illustrates a state in which a blank 203 is set on a die 204 fixed to a press bed 211 and a peripheral portion 203*b* of the blank is binded against a die surface 204*a* at a predetermined load with use of a blank holder 205, the blank holder 205 being attached to outer slide 212 which has been moved down from above by means of a drive unit (not shown).

At this time, the peripheral portion of the blank is clamped with concave and convex portions 208 ("beads" hereinafter) formed opposedly on both die surface 204*a* and blank holder surface 205*b* around a die cavity 204*e*. Next, a punch 206 attached to inner slide 213 which has been brought down from above by another drive unit (not shown) is moved down through a space formed inside the blank holder. When the punch 206 comes into contact with a sheet blank 203*a* positioned within a die cavity, a tensile force acts on the blank because the peripheral portion of the blank is pressed by both die and blank holder.

With descent of the punch, the said tensile force increases and the peripheral portion of the blank is pulled in toward the die cavity.

FIG. 8B shows a state in which the punch has descended to a bottom of the die cavity and a stretch formed portion (also referred to as "panel surface") 207*a* is formed between a punch surface 206*a* and a die bottom 204*b*. Thereafter, the punch and subsequently the blank holder are raised and a formed part 207 is taken out.

FIG. 8C illustrates the formed part. Bead patterns 207*d* formed by the beads 208 remain on a peripheral portion ("flange" hereinafter) 207*b* of the formed part. In steps which follow the flange is cut off to obtain the panel part 201.

In the above press stamping it is important that the stretch formed portion, or the panel surface, be allowed to undergo a stretch deformation with a tensile force.

The first reason is that in case of the panel surface being a curved surface and if stretch deformation is extremely small, the product is prevented from having a predetermined radius of curvature due to an elastic recovery. In this case there also arises an inconvenience such that a elastic stiffness (difficulty of elastic deflection) of the panel surface is low and there occurs "canning" when a local load is applied to the panel surface.

The second reason is that if an increase in yield stress (σA') of the panel surface induced by stretch deformation is small, the foregoing dent resistance becomes insufficient.

The material of the panel surface is in a biaxially stretched state under the action of a surrounding tensile force, and for increasing the amount of stretch deformation of the panel surface it is necessary to increase the tensile force acting on the panel surface during press forming. The larger the strength and thickness of the metallic sheet and the area of the panel surface are, the larger the tensile force required for stretching the panel surface is. This tensile force is created by resistance ("drawing resistance" hereinafter) which is induced when the flange is pulled into the die cavity by the punch. The larger the holding force (also referred to as "blank holder force" hereinafter) of the blank holder and the larger the flange area, the higher the drawing resistance.

However, the blank holder force is restricted by the capacity of the press machine used and the flange area is set to a minimum area from the standpoint of blank yield, so with these means it is difficult to ensure a required drawing resistance. The bead compensates for the deficiency in the drawing resistance. A drawing resistance is created by a bending deformation induced when the flange passes the bead. Usually, the bead is arranged at a position where the drawing resistance of the flange is small, such as a straight side portion of the die cavity contour, as shown in FIG. 8C.

In press stamping, a problem is encountered such that the drawing resistance is difficult to be transmitted directly as a force of deforming the panel surface. The following two are considered as factors of this problem.

According to the first factor, a friction occurs between the punch surface and a punch shoulder 206*b* and this frictional force suppresses the stretch deformation of the panel surface. The larger the area of the punch surface is, the more influential the friction is.

The second factor is a bending at the punch shoulder. For the material to stretch at the panel surface it is necessary that the material moves to the side wall through the punch shoulder. This is obstructed by both bend and friction at the punch shoulder. The smaller the profile radius of the punch shoulder is, the greater the influence thereof is.

Since the stretch deformation of the panel surface is suppressed by the above factors, it is difficult to increase the stretch deformation of the panel surface even if a forming depth (H) shown in FIG. 8C is increased. A value ("equivalent strain of the stretched formed portion" or "ϵ eq" hereinafter) obtained by converting a biaxial tensile elongation on the panel surface by press stamping into a uniaxial tensile elongation is 2% or so at most and thus the deficiency in dent resistance becomes a problem even if the elastic stiffness is satisfied.

Further increasing the equivalent strain of the stretch formed portion and improving the yield stress (σA') of the panel surface by work hardening is difficult with the above press stamping method and there has been adopted the thinking that a strength characteristic of a metallic sheet blank is to be selected so as to satisfy a panel surface yield stress (σA') required for dent resistance even if ϵ eq is small. That is, in case of decreasing the thickness of a panel part for the reduction of weight, which brings a decrease in dent resistance, it is necessary to change to a metallic sheet of a higher strength so as not to cause a lowering of dent resistance. For example, what is called a high strength steel sheet has so far been used.

As the yield point stress of blank increases, an elastic recovery after press forming becomes larger, thus giving rise to the problem that a predetermined product shape cannot be obtained. Thus, an upper limit is encountered in the yield point stress (σA) of blank. Generally there is used a blank having a yield point stress of 280 Mpa or less.

As noted above, since ϵ eq obtained in press stamping is 2% or so at most, the panel surface yield point stress (σA') is 320 MPa or so at most. Therefore, it is inevitably required to select a suitable sheet blank thickness so as to satisfy a required dent resistance at such a panel surface yield point stress, and thus a limit is encountered in reducing the thickness and weight of a panel part.

SUMMARY OF THE INVENTION

The present invention has been accomplished in view of the above-mentioned problems and it is an object of the invention to provide a sheet hydroforming method wherein a pressurized fluid can be injected between mating surfaces of two blanks easily and without leakage of the fluid, further provide a forming die used therein and a formed part on workpiece obtained by the method, as well as the above method able to improve dent resistance, a forming die used therein and a formed product obtained by the method.

For achieving the above-mentioned object, the inventors in the present case have studied the foregoing conventional problems and obtained the following knowledge.

a) A thru-hole to introduce a pressurized fluid, which leads to a holding surface of a die, is formed in the die, and a pierced hole to introduce the fluid formed in a portion of stacked metallic sheets, which portion is in contact with the holding surface of the die, is positioned with the thru-hole formed in the die, then the pressurized fluid is injected between mating surfaces of the metallic sheets from the thru-hole in the die through the pierced hole on blank, allowing a channel to be formed to introduce the pressurized fluid into a portion to be bulged. According to this method, the fluid can be injected between the mating surfaces of the metallic sheets easily without leakage thereof, whereby the forming work can be done efficiently.

b) A dent load of a formed part increases with an increase in equivalent strain of the stretch formed portion of workpiece, but when the equivalent strain of the stretch formed portion (also called "equivalent strain of the panel surface" hereinafter) saturates at 10% or so and increases to a further extent, the dent resistance load becomes lower. This is because a lowering in dent resistance caused by a decrease in thickness of stretch formed portion becomes more influential than the improvement in dent resistance of the stretch formed portion of workpiece based on work hardening.

The present invention has been accomplished on the basis of the above knowledge and the gist thereof is summarized in the following points (1) to (10):

(1) A metallic sheet hydroforming method comprising:
- pressing and clamping two stacked metallic sheets between holding surfaces of a pair of upper and lower dies having die cavities of the same inner contour shape as an outer contour shape of product;
- forming a thru-hole in one of the dies for the injection of a fluid, the thru-hole being led to the holding surface of the one die;
- positioning a pierced hole for the injection of the fluid with the thru-hole in the one die, the pierced hole being formed in a portion of one of the metallic sheets which portion is in contact with the holding surface of the one die; and
- introducing the fluid in a pressurized state between the mating surfaces of the two stacked metallic sheets from the thru-hole in the one die through the pierced hole formed in the one metallic sheet blank, thereby causing the metallic sheets to bulge within a space defined by the die cavities.

(2) A metallic sheet hydroforming method as described in the above (1), wherein the two stacked metallic sheets are bonded together at respective mating surfaces in an area outside to-be-bulged portions and outside the thru-hole formed in one metallic sheet.

(3) A metallic sheet hydroforming method as described in the above (1) or (2), wherein after the metallic sheets have been bulged by introducing the pressurized fluid between the mating surfaces of the metallic sheets, portions which are in contact with the holding surfaces of the dies and which are unnecessary as product are cut off, thereby obtaining two formed parts at a time.

(4) A metallic sheet hydroforming method as described in any of the above (1) to (3), wherein the portion(s) to be bulged of one or both of the metallic sheets is (are) formed in a three-dimensional shape beforehand.

(5) A metallic sheet hydroforming method as described in any of the above (1) to (4), wherein after the metallic sheets have been stretch formed, one or both stretch formed portion(s) of workpiece is (are) punched to form a hole(s) with a punch incorporated in one or both of the dies, and the fluid is discharged from the hole(s).

(6) A metallic sheet hydroforming method as described in any of the above (1) to (5), wherein an equivalent strain of the stretch formed portion of workpiece obtained by bulging the metallic sheets is in the range of 2% to 10%.

(7) A hydroforming die comprising:
- a pair of upper and lower dies having die cavities of the same inner contour shape as an outer contour shape of a product;
- a thru-hole formed in one of the dies for the injection of a pressurized fluid, the thru-hole being led to a holding surface of the one die; and
- a channel-forming groove formed in a holding surface of the other die, the channel-forming groove being extended to the die cavities through a portion opposed to the thru-hole formed in the one die.

(8) A hydroforming die as described in the above (7), wherein one or both of the dies has (have) means for piercing a fluid discharge hole on a stretch formed portion on workpiece after forming.

(9) A hydroformed product obtained by injecting a fluid between mating surfaces of two stacked metallic sheet blanks and pressurizing the fluid to bulge the blanks, the hydroformed product having a convex fluid channel extending to a stretch formed portion and also having a pierced hole on the blank opposed to the convex fluid channel.

(10) A hydroformed product obtained by injecting a fluid between mating surfaces of two stacked metallic sheets and pressurizing the fluid to bulge the blanks, the product having an equivalent strain of the stretch formed portion of workpiece in the range of 2% to 10%.

The two stacked metallic sheets are obtained by superimposing one metallic sheet on the other metallic sheet. As one or both of such blanks there are included a laminate of plural metallic sheets and a composite of both a metallic sheet and a sheet of a non-metallic material such as plastic.

BRIEF DESCRIPTION OF THE DRAWINGS

FIGS. 1A, 1B, 1C, and 1D are diagrams for explaining a conventional hydroforming method for a double sheet blank, of which FIG. 1A is a perspective view of two blanks, FIG. 1B is a sectional view of a die portion before a forming work, FIG. 1C is a sectional view showing a completed state of hydroforming, and FIG. 1D is a perspective view of a bent tubular part obtained by cutting a formed part.

FIGS. 2A and 2B are diagrams for explaining a conventional forming method, of which FIG. 2A is a perspective view of a welded double sheet blank before forming and FIG. 2B is a perspective view of a formed part.

FIGS. 3A, 3B, 3C, 3D, and 3E are diagrams for explaining a conventional forming method, of which FIG. 3A shows blanks before forming, FIG. 3B shows a welded double sheet blank, FIG. 3C shows the double blank as clamped with dies, FIG. 3D shows a completely stretch formed state, and FIG. 3E shows an example of a tubular part obtained.

FIGS. 5A, 5B, and 5C are diagrams for explaining a dent resistance testing method, of which FIG. 5A shows a loaded state to a panel part, FIG. 5B shows the panel part after removal of the load, and FIG. 5C is an enlarged view of an arrow B portion in FIG. 5B.

FIGS. 8A, 8B, and 8C are diagrams for explaining a conventional press stamping method, of which FIG. 8A shows a blankholding state of a blank peripheral portion, FIG. 8B shows a formed state of a panel surface, and FIG. 8C shows a formed part.

FIGS. 9A and 9B are perspective views of blanks used in the forming method of the present invention, of which FIG. 9A is a perspective view of a blank and FIG. 9B illustrates a blank with a pierced hole therein.

FIGS. 10A, 10B, and 10C are perspective views showing examples of stacked, double sheet blanks, of which FIG. 10A shows a merely stacked double sheet blank or a double sheet blank obtained by partially bonding edge portions and the vicinities thereof by, for example, spot welding for ease of handling, FIG. 10B shows a bonded blank obtained by bonding and integrating blanks throughout the whole circumference by, for example, laser welding, and FIG. 10C shows a double sheet blank obtained by bonding blanks by using an adhesive in a planar area.

FIGS. 12A, 12B, and 12C are enlarged diagrams of a portion C indicated with a dotted line in FIG. 11, of which FIG. 12A is a diagram for explaining a fluid sealing method in an opening of a thru-hole formed in a die which opening faces a holding surface of the die, FIG. 12B is a sectional view as seen in the arrowed direction E-E in FIG. 12A, and FIG. 12C illustrates a state in which a blank has been pushed up locally with a fluid introduced from the thru-hole formed in the die.

FIGS. 15A and 15B are sectional views showing a method of punching a bottom of a formed part to form a hole, of which FIG. 15A illustrates a punch and a hydraulic cylinder both incorporated in a die and FIG. 15B shows an example of a punched state of the bottom of the formed part with use of a raised punch without separation of slug 51.

FIGS. 16A, 16B, and 16C are perspective views of formed parts, of which FIG. 16A shows a formed part of the blank 4 illustrated in FIG. 10A, and FIGS. 16B and 16C show panel parts obtained after cutting off a flange portion.

FIGS. 17A and 17B are perspective views of formed parts of further different modes, of which FIG. 17A shows a formed part of the blank 5 illustrated in FIG. 10B and FIG. 17B shows a formed part of the blank 7 illustrated in FIG. 10C.

FIGS. 21A and 21B are diagrams for explaining a further mode of blank according to the present invention, of which FIG. 21A is a perspective view of a blank preformed with a convex portion capable of being received in a channel-forming groove of a die and a blank having a pierced hole, and FIG. 21B shows a state in which a bonded blank is clamped with upper and lower dies.

FIGS. 22A, 22B, and 22C are diagrams for explaining a still further mode of blank according to the present invention, of which FIG. 22A is a perspective view of a blank having a pierced hole formed in a convex portion which projects in a direction opposite to a blank mating surface, FIG. 22B is an enlarged view of an arrow C portion in FIG. 11 in a state in which the blank having the pierced hole has been clamped with upper and lower dies, and FIG. 22C is a sectional view as seen in an arrowed F—F direction in FIG. 22B.

FIG. 23C shows the preformed double sheet blank and FIG. 23D is a sectional view of FIG. 23C.

DESCRIPTION OF PREFERRED EMBODIMENTS

Embodiments of the present invention will be described in detail hereinunder with reference to the accompanying drawings.

1) Working Process

Figure 9A:
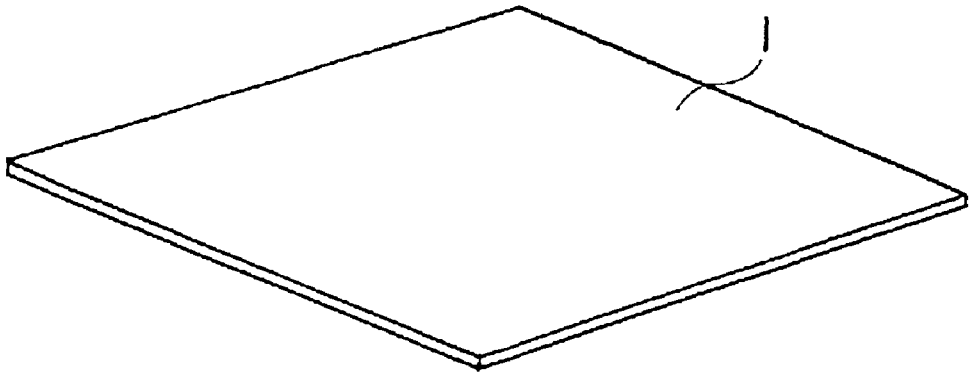
Figure 9B:
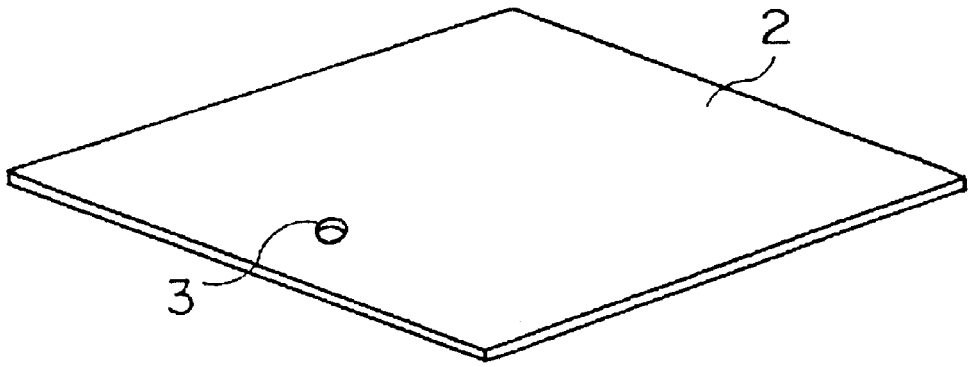

FIGS. 9A and 9B are perspective views showing an example of blanks used in the hydroforming method of the present invention, of which FIG. 9A shows a blank 1 and FIG. 9B shows a blank 2 having a pierced hole for the injection of fluid in a predetermined position, the pierced hole being formed, for example, by punching or by a laser cutting method. As to the diameter, d, of the pierced hole 3, it will be described later. The pierced hole 3 may be provided in a plural number. Although blanks will hereinafter be described as two blanks 1 and 2, the present invention is also applicable to the case where one or both of the blanks 1 and 2 is (are) a laminate(s) of plural metallic sheets or a stacked composite(s) of a metallic sheet and a non-metallic sheet such as plastic.

The present invention is further applicable even to the case where one or both of the blanks 1 and 2 is (are) a tailored blank(s) obtained by bonding edge portions or the vicinity thereof of plural metallic sheets of the same material and different thicknesses or plural metallic sheets of the same thickness and formed of different materials by a suitable boding method such as welding.

Figure 10A:
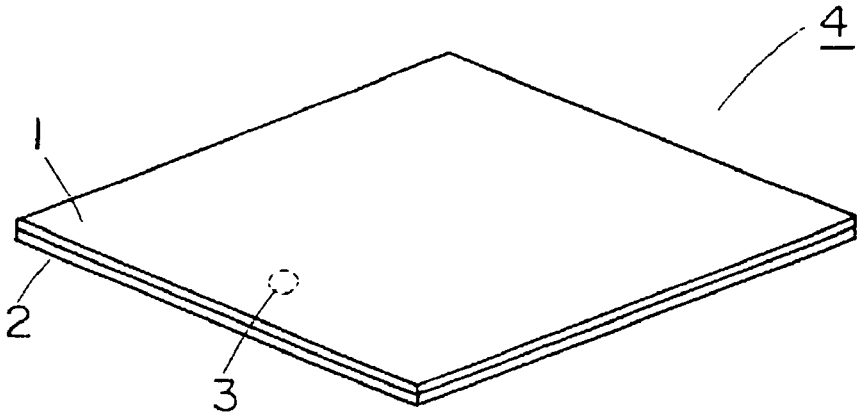
Figure 10B:
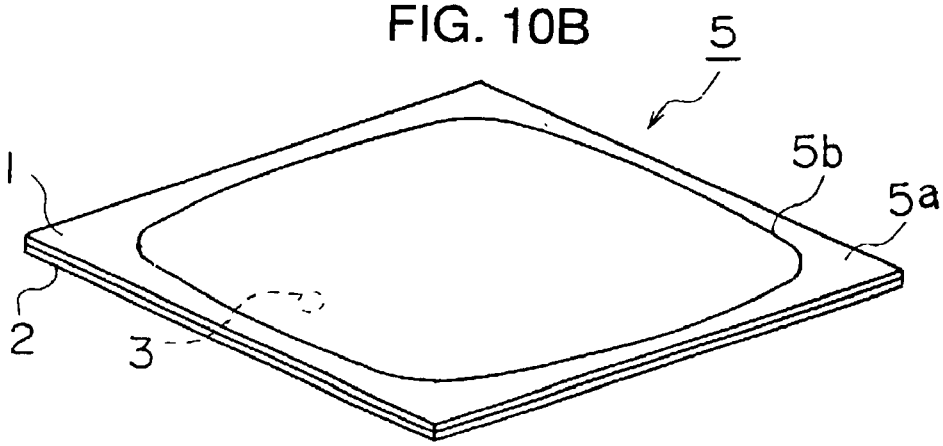
Figure 10C:
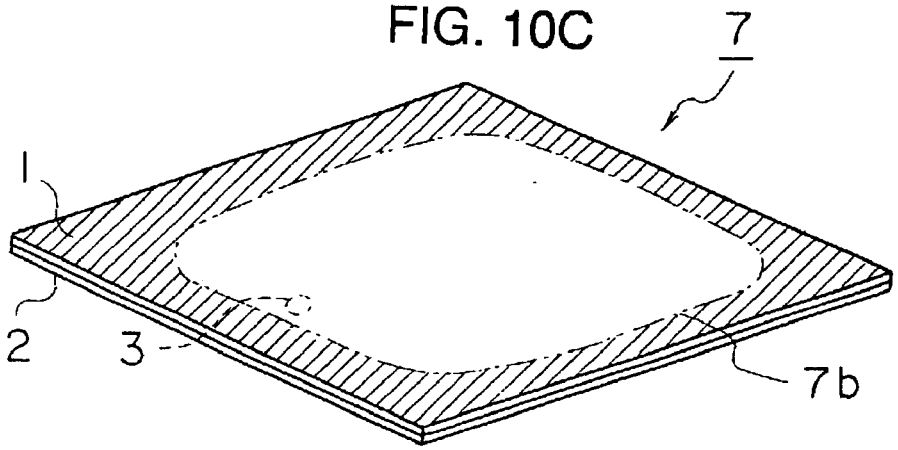

FIGS. 10A, 10B, and 10C are perspective views showing different modes of double sheet blanks each comprising blanks 1 and 2 superimposed together and employable in the present invention. FIG. 10A shows a double sheet blank 4 of merely stacked blanks. For preventing the constituent blanks from being disjoined during handling, the blanks may be bonded at several positions near their edge portions by spot welding for example. FIG. 10B shows a double sheet blank 5 obtained by superimposing the blanks 1 and 2 together and welding the two into an integral mass throughout the whole circumference by laser welding for example. As to the position of a welded line 5*b*, it will be described later. The pierced hole 3 is formed in a position inside a welded line and positioned with a thru-hole formed in a die for introducing a pressurized medium when the blank is set on the die, which thru-hole will be described later. FIG. 10C shows an example of a double sheet blank 7 of a further different mode. Interfaces of the blanks 1 and 2 are integrally bonded in a hatched planar area ("bonded area" hereinafter) located outside a closed curve 7*b* ("inside contour line of bonded area" hereinafter) which is represented by a dash-double dot line, by bonding with adhesive or brazing. The hatched area represents a bonded area on mating surfaces of the blanks 1 and 2. As to the blank bonded area, it will be described later. Also in this case, a pierced hole on blank may be formed in a position inside the bonded area which position may be set in the same manner as is the case with the welded line 5*b* of the double sheet blank 5 in FIG. 10B.

Figure 11:
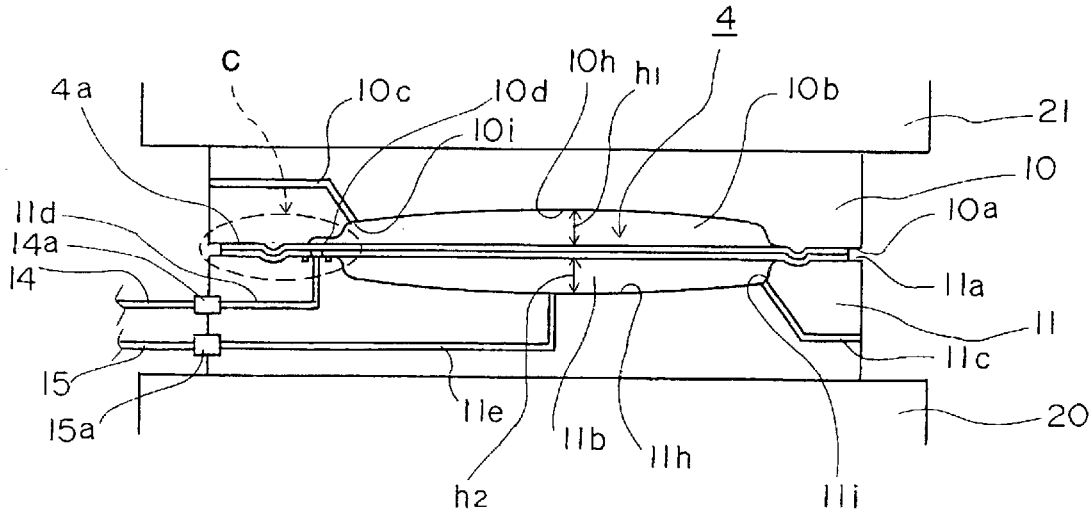
FIG. 11 is a sectional view of upper and lower die portions for explaining the forming method of the present invention.

FIG. 11 is a sectional view of a die portion for explaining an example of the hydroforming method of the present invention using the double sheet blank 4. The same figure shows a state in which the double sheet blank 4 is set on a holding surface 11*a* of a lower die 11 fixed to a bed 20 of a press machine (not shown), a slide 21 of the press machine with an upper die 10 attached thereto is brought down with a drive unit (not shown), allowing a holding surface 10*a* of the upper die to come into contact with the double sheet blank, and the slide is pressed with a pressing device (not shown) to clamp a peripheral plane portion 4*a* ("flange" hereinafter) of the double sheet blank. In the upper and lower dies 10, 11 are respectively formed die cavities 10*b* and 11*b* having the same inner contour shape as an outer contour shape of product.

In an outer side face of the lower die a thru-hole 11*d* is formed for introducing a pressurized medium which thru-hole lead to the holding surface of the lower die. The lower die is sideways provided with a connector 14*a* so as to permit connection with and disconnection from piping 14. In the holding surface of the upper die is formed a channel-forming groove 10*d* in a position opposed to the thru-hole formed in the die so as to extend to the upper die cavity.

In a bottom of the lower die cavity a drain hole 11*e* is formed leading to piping 15 which is connected removably to the connector 15*a*. Air exhaust thru-holes 10*c* and 11*c* leading to the exterior of the die portion from the die cavities 10*b* and 11*b* are formed in the upper and lower dies respectively. The air exhaust thru-holes are formed, for example, in round corner portions 10*i* and 11*i* so that indentation thereof may not remain in the resulting formed part.

Figure 12A:
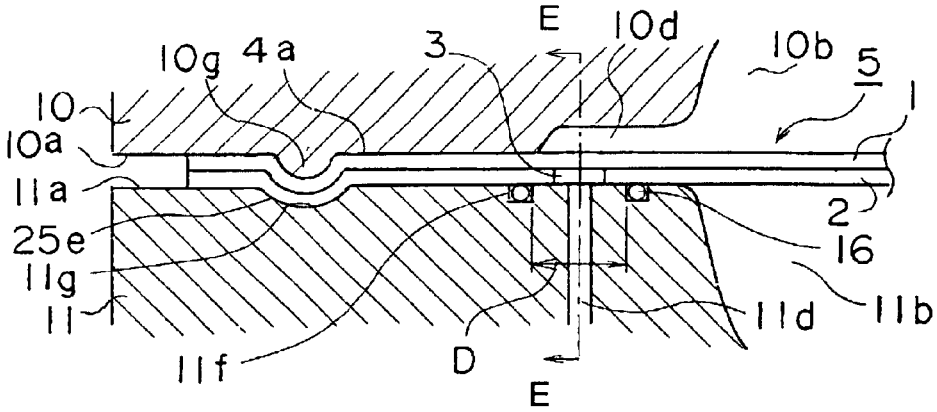
Figure 12B:
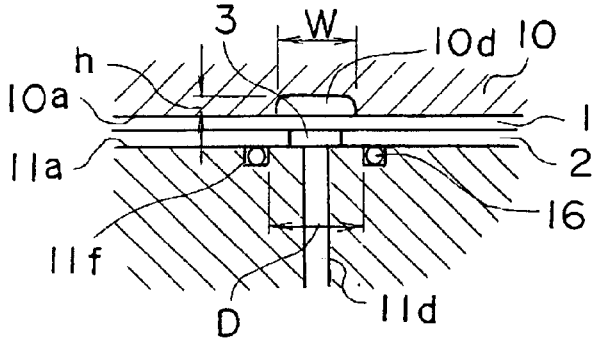
Figure 12C:
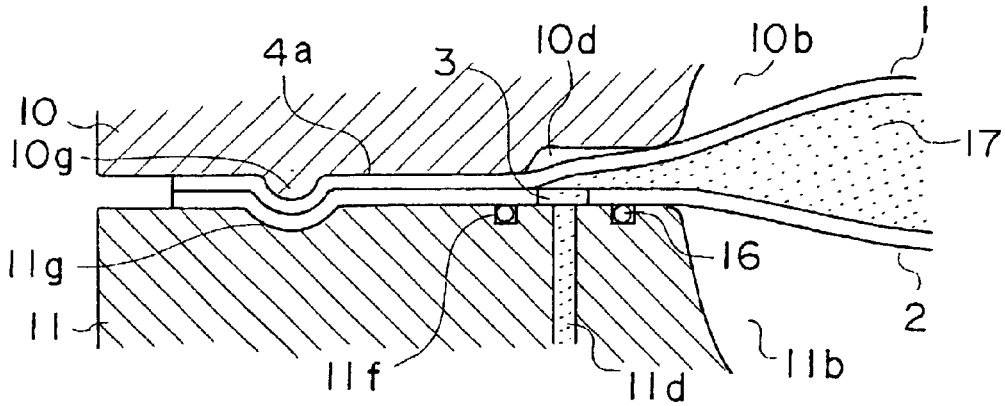

FIGS. 12A, 12B, and 12C are enlarged diagrams of a portion C enclosed with a dotted line in FIG. 11, of which FIG. 12A is a diagram for explaining a fluid sealing method in an opening of the thru-hole 11*d* in the lower die which opening faces the holding surface of the die. As shown in the same figure, a circular groove 11*f* is formed in the holding surface 11*a* of the lower die so as to surround the thru-hole 11*d*. An O-ring 16 made of an elastic material such as rubber is fitted in the circular groove. An inside diameter (D) of the circular groove, as well as the width and depth of the same groove, may be determined in accordance with the inside diameter and thickness of the O-ring and on the basis of, for example, JIS B2406.

The pierced hole 3 on blank is located at the same position as the thru-hole 11*d* and its diameter (d) is determined smaller than the inside diameter (D) of the circular groove. The holding surfaces of the upper and lower dies are formed with a bead 10*g* and a bead groove 11*g* respectively at a position outside the channel-forming groove 10*d* and thus a local concave-convex pattern ("bead pattern" hereinafter) 25*e* is formed on a flange 4*a*. Vertical positions of the bead and the bead groove may be reversed. The bead pattern is formed by clamping the double sheet blank with the upper and lower dies. As to the role of the bead pattern 25*e*, it will be described later.

FIG. 12B is a sectional view as seen in an arrowed direction E—E in FIG. 12A. The width (w) of the fluid channel is set equal to or somewhat smaller than the inside diameter (D) of the circular groove. As a result, with a certain pressing force of the holding surface of the upper die to the blanks 1 and 2, the O-ring is crushed elastically within the circular groove and the resulting surface pressure brings the space between the thru-hole 11*d* and the blank 2 into a sealed state. Fluid is fed from an external tank (not shown) through piping and the thru-hole 11*d* by means of a pump (not shown). The fluid thus fed first fills the pierced hole 3, and with the pressure of the fluid the upper sheet blank 1 is pushed up locally toward the channel-forming groove.

FIG. 12C shows this state, in which the blanks 1 and 2 are bulged within the upper and lower die cavities 10*b*, 11*b* with pressurized fluid 17 which has entered through the gap formed between both blanks. Of course, for effecting the stretch forming work efficiently, there may be used a double sheet blank having plural pierced holes 3, and the same number of such structures as indicated by arrow C in FIG. 11 may be provided at corresponding positions of the upper and lower dies.

As the fluid, water emulsion with oil or fat for rust prevention is most suitable in point of cost.

In the course of the stretch forming process, the air present within the upper and lower die cavities is discharged to the exterior gradually through the air exhaust thru-holes 10*c* and 11*c*.

Figure 13:
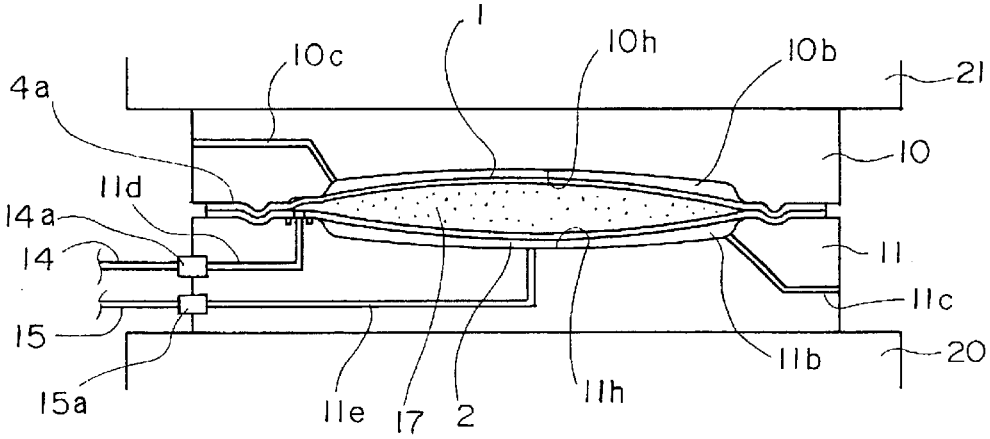
FIG. 13 illustrates a state in which stretch forming has been started with a fluid in the forming method of the present invention.

The steps which follow the pressurized medium injection step will now be described in more detail. FIG. 13 illustrates a state in which a bulging deformation with fluid has been started in the forming step. At this stage, the blanks 1 and 2 present within the die cavities bulge centrally in a dome shape. A stretch deformation of the blanks becomes the largest centrally of the dome-like bulged portion. The central bulging proceeds until the bulge top comes into contact with die cavity bottoms 10*h* and 11*h*. Thereafter, the area of contact with the die cavity bottoms becomes wider. The air present within the die cavities is discharged to the exterior gradually through the air exhaust thru-hole in the course of stretch formation.

Figure 14:
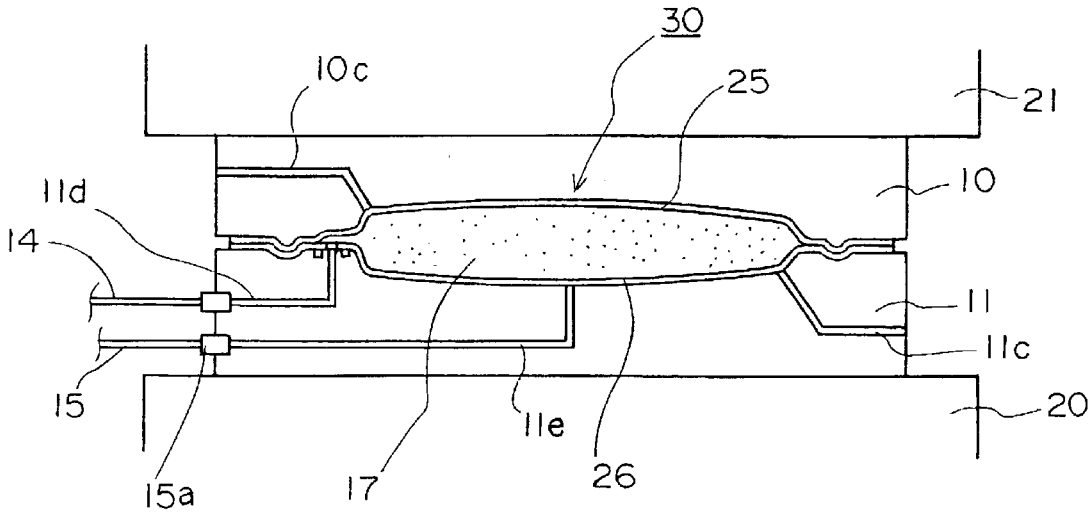
FIG. 14 illustrates a completely stretch formed state of a bonded blank within die cavities in the forming method of the present invention.

FIG. 14 shows a completed state of blank bulging in the die cavities. There is obtained a stretch formed part 30 composed of upper and lower formed parts 25, 26. Subsequently, the pressure of the pressurized medium is reduced, then the upper die is raised, the stretch formed part is lifted and taken out from the lower die, and medium is discharged from the pierced hole 3 on blank. At this time, the medium spilling into the lower die cavity is discharged from the drain hole 11*e*, then passes through a removable joint 15*a* and is returned for re-use into a tank (not shown) through piping. It goes without saying that if plural thru-holes for introducing pressurized medium are formed, the discharge of the medium can be done efficiently.

Figure 15A:
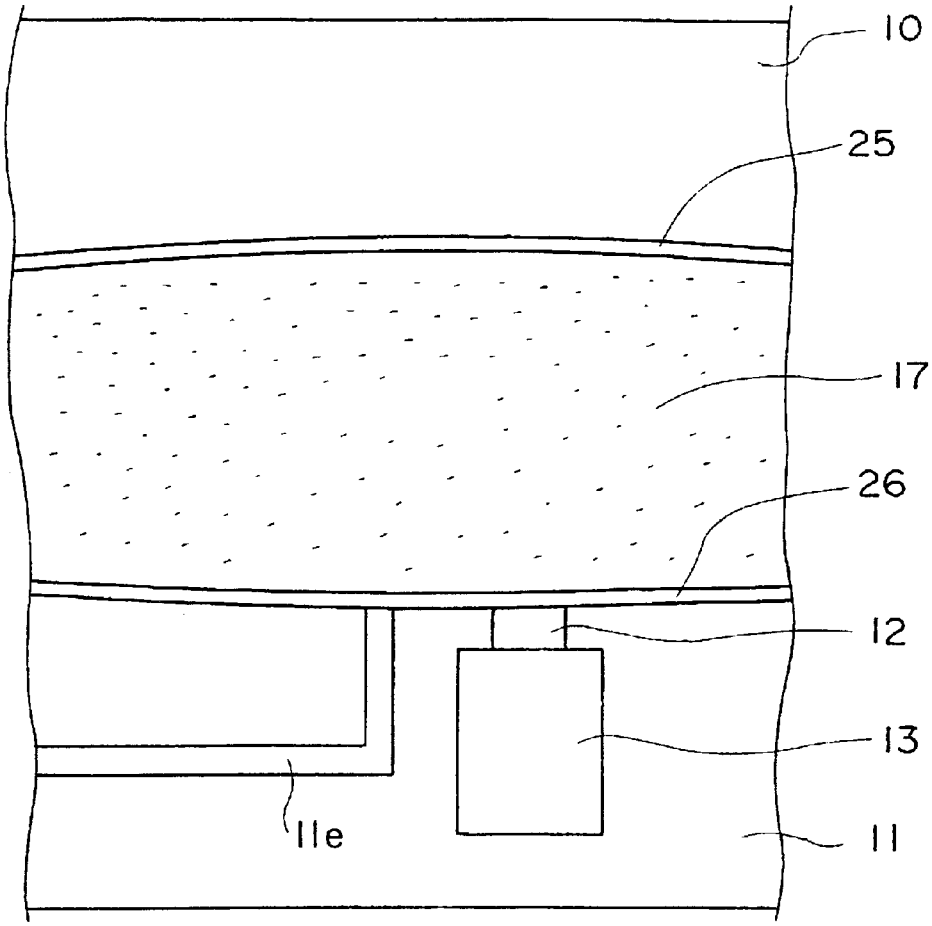
Figure 15B:
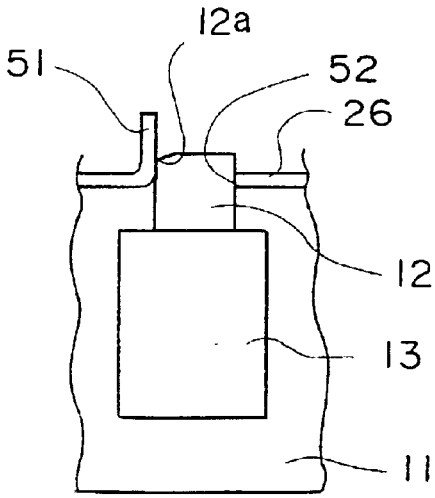

In case of forming a through hole in the stretch formed portion, a punching work may be done subsequent to the stretch forming work as shown, for example, in FIGS. 15A and 15B. In this case, as shown in FIG. 15A, a hydraulic cylinder 13 equipped with a piercing punch 12 is installed at a predetermined position within the die cavities, the blanks are allowed to contact the whole inner contour portions of the upper and lower die cavities, thereafter, while the pressurized medium is maintained at a predetermined pressure level, the hydraulic cylinder 13 is actuated to move the punch 12 forward to pierce a hole as shown in FIG. 15B for example. If a partial roundness 12*a* is formed at a peripheral edge portion of the tip of the punch 12, it is possible to pierce a hole without separation of slug 51, thus eliminating the necessity of slug recovery. Of course, a separative punching which premises the recovery of slug may also be done. After the end of the punching work, the pressure of the pressurized medium is reduced and the piercing punch is retracted. The resulting punched thru-hole on the lower side, indicated at 52, is also employable as a discharge hole for the medium. If such a punched thru-hole is formed also on the upper die side, it can be used as an air intake port at the time of discharging the medium, whereby the discharge of pressurized medium can be performed efficiently.

Figure 16A:
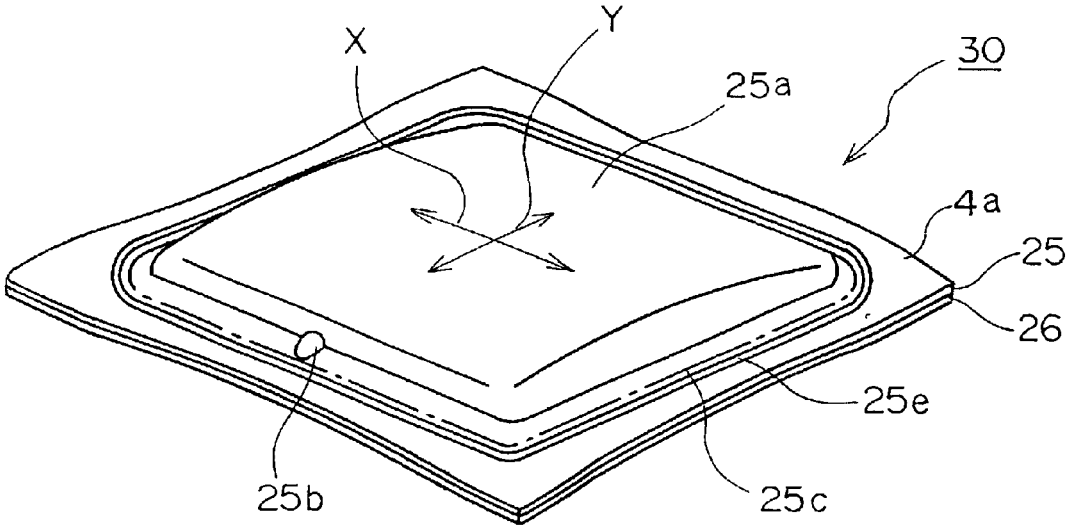
Figure 16B:
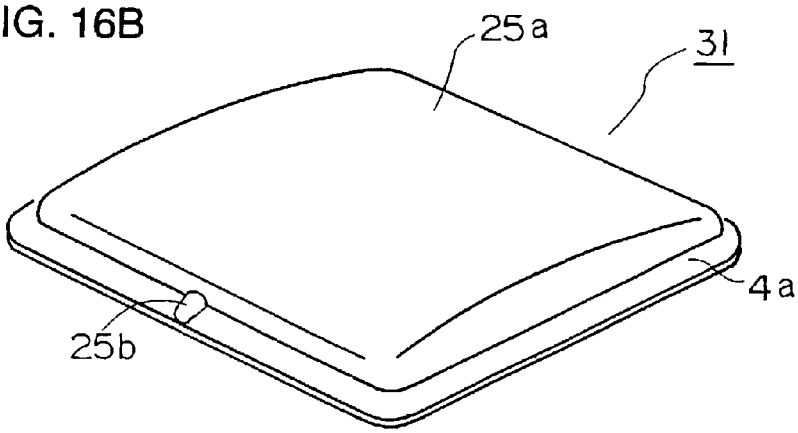
Figure 16C:
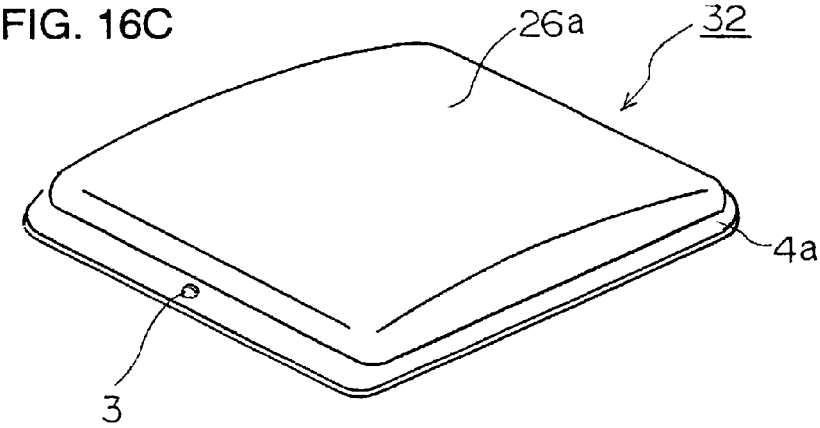

FIGS. 16A, 16B, and 16C are perspective views of formed parts, of which FIG. 16A shows a stretch formed part 30 just after the hydroforming. A protuberance 25*b*, which corresponds to the channel forming groove 10*d*, is formed adjacent to a stretch formed portion 25*a* of workpiece. On the flange 4*a* is formed a bead pattern 25*e* in a closed curve shape. The reason for this will be stated later. Thereafter, the flange is cut off along the position of a closed curve 25*c* (also referred to as "trimming line" hereinafter) located inside the bead pattern by a known means such as the use of a trimming die or by laser trimming. FIGS. 16B and 16C illustrate panel parts 31 and 32 obtained by separation up and down after cutting off the flange. In the case where the double sheet blank is a mere stack of two blanks, the flange may be cut off after separation into the upper and lower formed parts 25, 26.

The following description is now provided about cutting off the flange of a stretch formed part obtained by the hydroforming method illustrated in FIG. 11 and using the double sheet blanks 5 and 7 shown in FIGS. 10B and 10C.

Figure 17A:
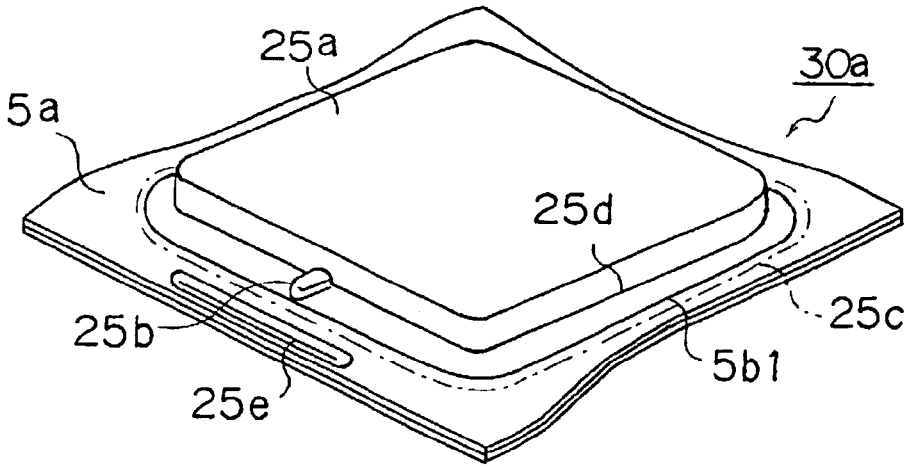
Figure 17B:
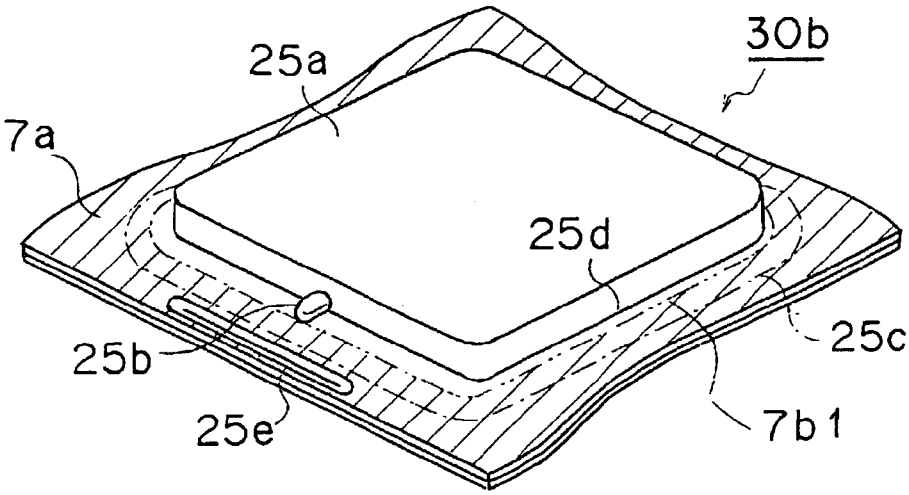

FIGS. 17A and 17B are perspective views of stretch formed parts 30*a* and 30*b* corresponding to the double sheet blanks 5 and 7, respectively. In each of both stretch formed parts, a protuberance 25*b* corresponding to the channel-forming groove 10*d* is formed in adjacency to a stretch formed portion 25*a*, and outside the protuberance 25*b* is formed a partial bead pattern 25*e*. The reason for this will be stated later. A welded line 5*b*1 on flange in FIG. 17A indicates in which position of the stretch formed part the welded line 5*b* of the double sheet blank 5 is located, while an inside contour line 7*b*1 of bonded area on the flange in FIG. 17B indicates in which position of the stretch formed part the inside contour line 7*b* of bonded area on the double sheet blank 7 is located. By cutting off the flange along a trimming line 25*c* located outside the welded line 5*b*1 or outside the inside contour line 7*b*1 there is obtained a product with the welded line or the bonded area left thereon.

Figure 18:
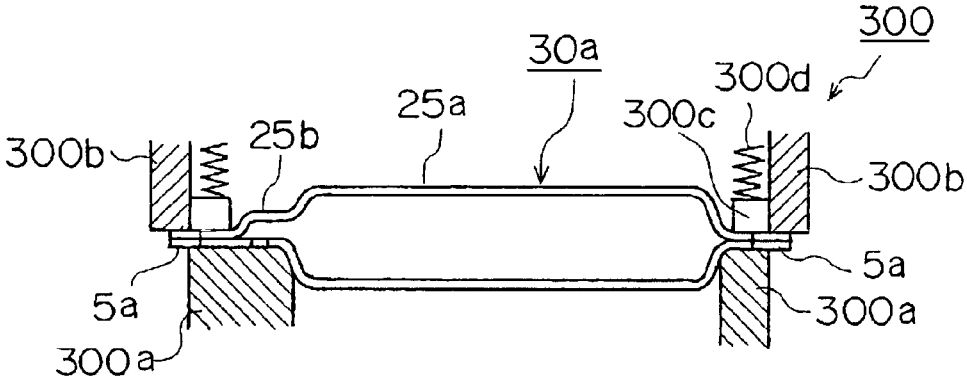
FIG. 18 is a sectional view for explaining a flange cutting method using a trimming die.

FIG. 18 is a sectional view showing an example of a flange cutting method for a stretch formed part 30*a* with use of a trimming die 300. The stretch formed part 30*a* is set on a lower die 300*a*, then while a flange 5*a* is clamped with a work holder 300*c* which is pressed with a spring 300*d*, an upper die 300*b* is brought down with a drive unit (not shown) to cut off the flange 5*a*. For allowing a welded line 5*b*1 of the formed part 30*a* to remain inside a trimming line 25*c*, the position of the welded line 5*b* on blank in FIG. 10B lies between a contour 25*d* of the stretch formed portion of workpiece and the trimming line 25*c*.

In the case of the double sheet blank 7 shown in FIG. 10C, a planar shape of the inside contour line 7*b* of bonded area on the blank 7 is set so that the inside contour line 7*b*1 of bonded area remains between the periphery 25*d* of the stretch formed portion and the trimming line 25*c*.

Of course, it is possible to cut the double sheet blank in such a manner that the welded line 5*b* of the double sheet blank and the bonded area thereof do not remain on product.

2) Function of Bead Pattern

In the hydroforming work shown in FIG. 11, the bead pattern formed on the flange fulfills the following three functions.

The first function is preventing pressurized medium from leaking to the exterior of the flange from the blank interface upon clamping the double sheet blank 4 shown in FIG. 10A between a bead and a bead groove with a high surface pressure. If the leakage occurs, the pressure of the pressurized medium lowers and it becomes impossible to obtain a predetermined shape of product. For fulfilling this function it is preferable that the bead pattern be formed throughout the whole circumference so as to surround the upper and lower die cavities as shown in FIG. 16A.

In the case where the flange thickness increases with draw-in of the flange into the die cavities and if such an increase in flange thickness differs depending on circumferential positions of the flange, the pressurized fluid will leak out to the exterior from the mating surfaces of the double sheet blank, so it is necessary to minimize the draw-in of the flange into the die cavities.

In the case of the double sheet blank 5 shown in FIG. 10B, the whole circumference is welded along the closed curve 5*b*, so even if the flange thickness becomes non-uniform due to draw-in of the flange into the die cavities, there is no fear of fluid leaking to the exterior of the flange from the boundary of both upper and lower blanks, and thus the above first function of the bead pattern is not needed. This is also the case where the bonded area of the double sheet blank 7 shown in FIG. 10C has a bonding strength high enough to prevent the leakage of fluid.

The second function is inhibiting the movement of the flange in the vicinity of the thru-hole which is formed in the lower die to introduce pressurized medium. In the stretch forming process shown in FIGS. 13 and 14, if a force acting to pull in the flange toward the upper and lower die cavities causes the flange to move and close the thru-hole formed in the lower die, it becomes impossible to continue the stretch forming work. Therefore, in the vicinity of the pierced hole on blank it is necessary that the movement of the flange be inhibited by the bead pattern.

It is for this reason that the bead pattern 25*e* is formed in the vicinity of the protuberance 25*b* in the stretch formed parts 30*a* and 30*b* using the double sheet blanks 5 and 7, as shown in FIGS. 17A and 17B.

The third function is increasing the flange movement resistance for increasing an equivalent strain of panel surface. As means for increasing the movement resistance of the flange without forming the bead pattern it is considered to increase the pressing force of the slide 21 and increase the drawing resistance of the flange based on an increase of the flange area. However, in the former case there arises the problem of an increase in equipment cost caused by an increase in size of the pressurizing equipment and also in the latter case there arises the problem of a decrease in blank yield.

Figure 19:
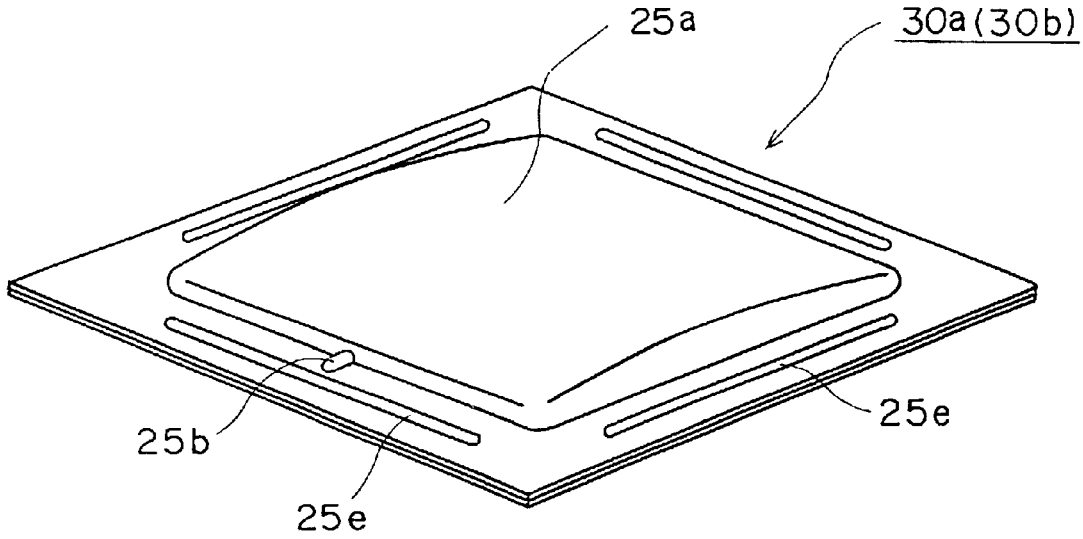
FIG. 19 is a perspective view of a formed part having bead patterns along straight side portions of a stretch formed portion 25*a*.

Forming the bead pattern is an effective means for inhibiting the flange movement without giving rise to the above problems and for increasing an equivalent strain of panel surface. The bead pattern for this purpose may be formed throughout the whole circumference as in FIG. 16A or at a position where the flange is apt to move toward the die cavities. FIG. 19 shows an example thereof, in which bead patterns are formed along straight side portions of the periphery of the stretch formed portion 25*a*.

Thus, a sectional shape of each bead pattern and a position thereof on the holding surface of the associated die may be selected according to the type of the double sheet blank used and an equivalent strain of a stretch formed portion which will be described later in such a manner as to fulfill the foregoing three functions.

3) Equivalent Strain of Stretch Formed Portion

A description will be given below about a stretch deformation of panel surfaces 25*a* and 26*a* of formed parts obtained by the hydroforming process.

In the hydroforming process, as noted earlier, a stretch deformation caused by fluid begins with a central portion of the panel surface, as shown in FIG. 13. Until the stretch formed portion comes into contact with the bottoms of both upper and lower die cavities, the top of the stretch formed portion undergoes the largest stretch deformation. Upon contact of the stretch formed portion with the bottoms of both upper and lower die cavities, increase of the stretch deformation of the contact area becomes small due to friction with the bottoms of the die cavities, but instead the stretch deformation of the surrounding non-contact area increases, with the result that the stretch deformation proceeds throughout the whole area of the panel surface.

Factors which dominate the amount of stretch deformation of the panel surface are upper and lower die depths h1, h2, frictional coefficients between the upper, lower die cavity bottoms 10*h*, 11*h* and metallic sheets, and the amount of flange movement toward the die cavities. With an increase of the upper and lower die depths, with a decrease of the frictional coefficients and with a decrease in the amount of flange movement, the amount of stretch deformation of the panel surface increases. Therefore, by adjusting these factors it is possible to control the amount of stretch deformation of the panel surface.

For example, given that the direction in which there occurs the maximum elongation is the arrow X in FIG. 16A, the foregoing equivalent strain of panel surface is calculated by measuring a strain in the X direction and a strain in an arrow Y direction orthogonal thereto and in accordance with the following equation (1):

$$\epsilon\, eq=(2/\sqrt{3})\times\sqrt{(\epsilon x^2+\epsilon x\times\epsilon y+\epsilon y^2)} \quad (1)$$

where, $\epsilon$ eq: equivalent strain of panel surface $\epsilon$ x: strain in X direction (logarithmic strain)

$\epsilon$ y: strain in Y direction (logarithmic strain)

The equivalent strain ($\epsilon$ eq) is calculated as a logarithmic strain, but for ease of understanding, it will be described below in a converted form into a conventional strain represented by %.

The present inventors have searched a relation between the equivalent strain of stretch formed portion, or panel surface, and dent resistance in connection with the hydroforming.

Two blanks of a square shape having a one-side length of 600 mm each constituted by a steel sheet having a thickness of 0.7 mm, a yield point of 210 MPa and a tensile strength of 370 MPa were put one on the other and welded throughout the whole circumference thereof to provide a double sheet blank 5. Then, stretch formed parts were formed and measured for an equivalent strain of panel surface, using five sets of upper and lower dies 10, 11 each having upper and lower die cavities 10*b*, 11*b* in FIG. 11 of a square shape 400 mm in one side in plane and each having a bead pattern 25*c* throughout the whole circumference thereof, the upper and lower die cavities 10*b*, 11*b* having bottoms 10*h* and 11*h* of a curvature radius of 2000 mm, the bottoms 10*h* and 11*h* in the five sets of upper and lower dies being 20, 30, 40, 50, and 60 mm, respectively, in depth (h1 and h2).

Further, in each of the formed parts, a flange portion was cut off and the formed part was separated into upper and lower formed parts, then a concentrated load was applied to a central portion of panel surface through a semi-spherical indentor made of urethane rubber (Hardness Hs=70) with a radius of 25 mm. After release of the load there was determined a load (dent resistance load) of creating a dent of 0.02 mm in depth.

Figure 20:
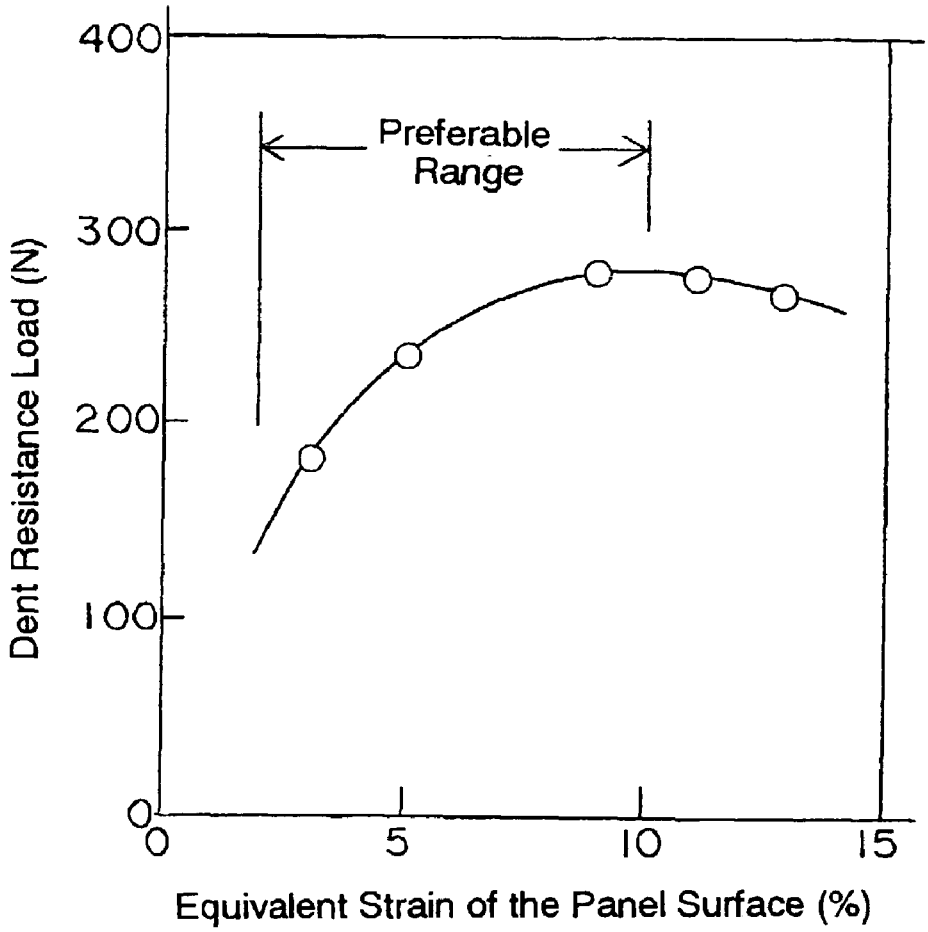
FIG. 20 is a diagram of a test result showing a relation between an equivalent strain of a panel surface (stretch formed portion) and a dent resistance load.

FIG. 20 is a diagram of a test result showing a relation between an equivalent strain of panel surface (stretch formed portion) and a dent resistance load, both being plotted depth by depth. From the illustrated result it is seen that the dent resistance load increases with an increase in the equivalent strain of panel surface, but the dent resistance load reaches saturation at an equivalent strain of panel surface of 10% or so, and that at larger equivalent strains the dent resistance load decreases. This is because a lowering of dent resistance caused by a decrease of thickness of stretch formed portion becomes more influential than the improvement of dent resistance based on work hardening of the stretch formed portion of the each formed part.

For the panel part, not only the dent resistance, but also a elastic stiffness of panel surface against a concentrated load at a dent-free condition is required. Since the elastic stiffness decreases with a decrease in thickness of stretch formed portion, even if an equivalent strain of panel surface not improving the dent resistance is given, there accrues no advantage.

In view of the above result an upper limit value of the equivalent strain of panel surface was set at 10%. On the other hand, as to a panel of less than 2% in terms of the equivalent strain of panel surface, a lower limit value of the equivalent strain of panel surface was set at 2% because it can be obtained also by the conventional press stampig method.

4) Forming Method in Another Mode

Figure 21A:
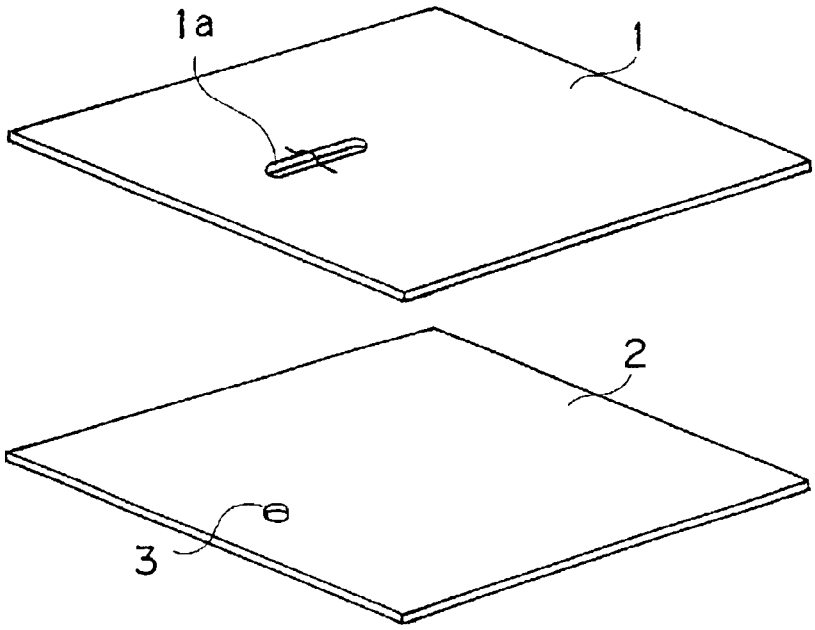
Figure 21B:
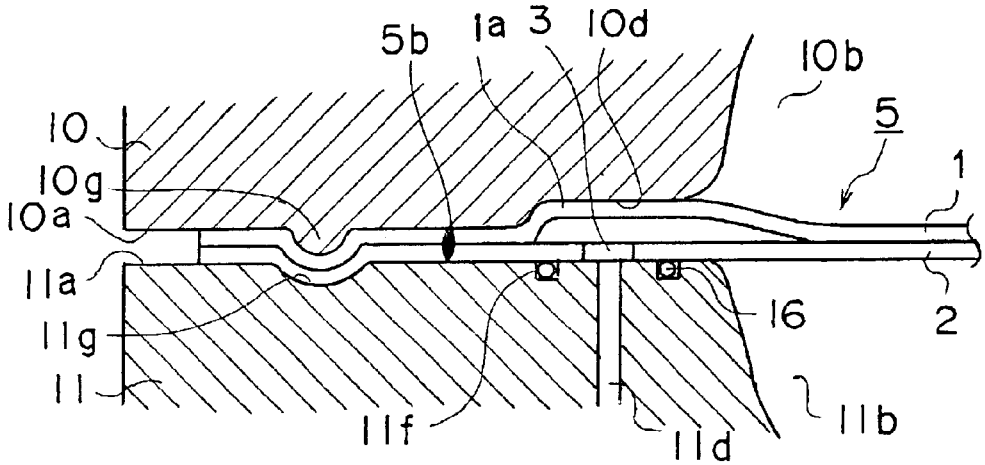

FIGS. 21A and 21B illustrate another mode of a forming method according to the present invention. FIG. 21A is a perspective view of blanks 1 and 2, with a protuberance 1*a* of a size capable of being received within the channel-forming groove 10*d* being preformed in the blank 1 by, for example, press stamping at the position of the channel-forming groove 10*d* shown in FIG. 11. FIG. 21B is a sectional view of a holding surface portion of the upper and lower dies 10, 11 illustrated in FIG. 11, showing a state in which a double sheet blank 5 obtained by a full-circled welding of both blanks 1 and 2 is clamped by the upper and lower dies 10, 11.

By using such blanks it is possible to feed a fluid between the mating surfaces of the blanks smoothly at a relatively low pressure at the beginning of the stretch forming work. This is because at the beginning of the stretch forming work it is not required to perform the same work for the protuberance 1*a* within the channel-forming groove 10*d* under a hydraulic pressure. The fluid fed from the thru-hole 11*d* immediately fills the internal space of the protuberance 1*a* formed on the blank 1 and both blanks 1 and 2 can be bulged by an increase of the fluid pressure. In this case, in order for the fluid to be fed smoothly, it is recommended that the length of protuberance 1*a* be set at a length which reaches the die cavity 10*b*.

Figure 22A:
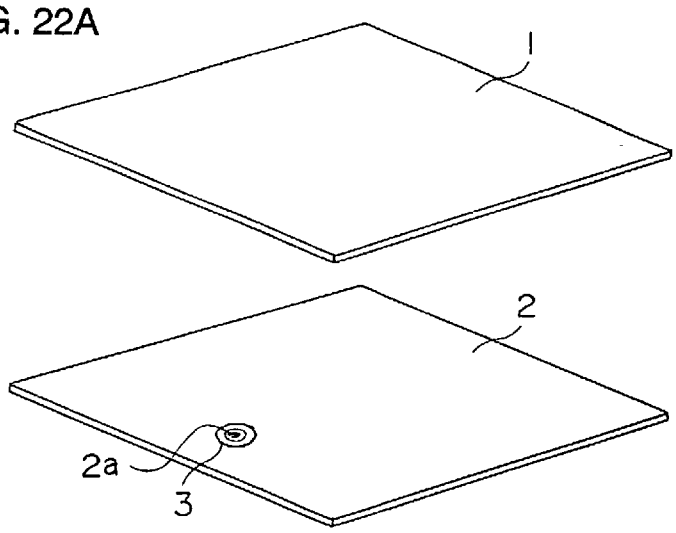
Figure 22B:
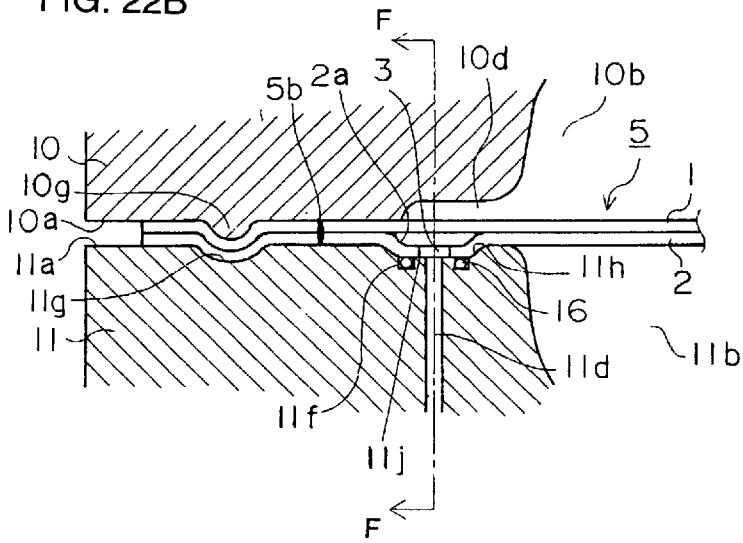
Figure 22C:
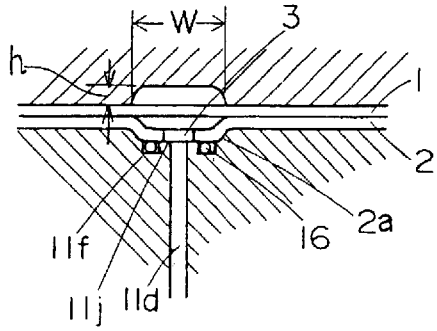

FIGS. 22A, 22B, and 22C illustrate another mode of a method which permits the stretch forming work to be done easily in the initial stage. FIG. 22A is a perspective view of a blank 1 and a blank 2, the blank 2 having a pierced hole 3 formed in a protuberance 2*a* which projects in a direction opposite to blank mating surfaces. FIG. 22B is a sectional view of a holding portion of an upper die 10 and a lower die 11, showing a state in which a blank 5 obtained by full-circled welding of the blanks 1 and 2 is clamped with both upper and lower dies 10, 11, the lower die 11 having a recess 11*h* of about the same inner contour shape as the outer contour shape of the protuberance 2*a*.

Since the protuberance 2*a* is in a three-dimensional shape, it has rigidity, and a sealing effect is created when an O-ring 16 is crushed with the pressing force at the time of clamping the double sheet blank by the upper and lower dies. For ensuring the sealing effect, the depth of the aforesaid recess is set equal to or slightly smaller than the depth of the protuberance on blank. Further, since the force of crushing the O-ring in the vertical direction is transmitted to the O-ring through the side wall of the protuberance, it is recommended to set the size of the protuberance in such a manner that the O-ring is positioned near the side wall of the protuberance. In this case, since the O-ring is received within a recess formed in the lower die, there accrues an advantage that the fear of the O-ring coming off or being damaged for example at the time of setting the double sheet blank onto the lower die is small. There also is an advantage that the positioning of the double sheet blank and the dies relative to each other becomes easier by positioning the recess 11*h* formed in the lower die and the protuberance 2*a* on the blank 2 with each other.

Fluid fed from a thru-hole 11*d* formed in the bottom of the recess 11*h* immediately fills the internal space of the protuberance 2*a*, the blank 1 is pushed up locally toward a channel-forming groove 10*d* with the fluid pressure, and the fluid which has entered between the blanks 1 and 2 causes both blanks to bulge within die cavities 10*b* and 11*b*.

In the modes illustrated in FIGS. 21A, 21B and 22A, 22B there is an effect such that the pressure of the fluid injected into the protuberance 1*a* or 2*a* causes the O-ring 16 to be pushed against the lower die 11 to provide a seal before bulging the blanks 1 and 2.

Although the above modes are of the double sheet blank 5 obtained by full-circled welding of the upper and lower blanks 1, 2, this is also the case with the double sheet blanks 4 and 7.

Although in the above modes two planar blanks are used as portions to be bulged by the hydroforming work, the portion to be bulged of one or both blanks may be formed in a three-dimensional shape beforehand.

Figure 23A:
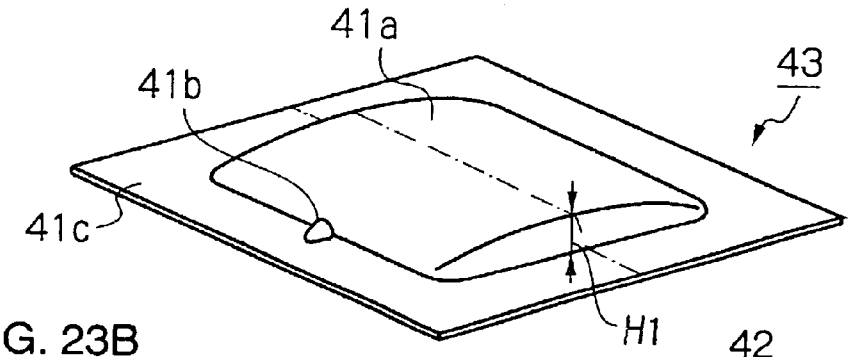
FIGS. 23A, 23B, 23C, and 23D show examples of preformed blanks used in the forming method of the present invention, of which FIGS. 23A and and 23B show the preformed blanks.
Figure 23B:
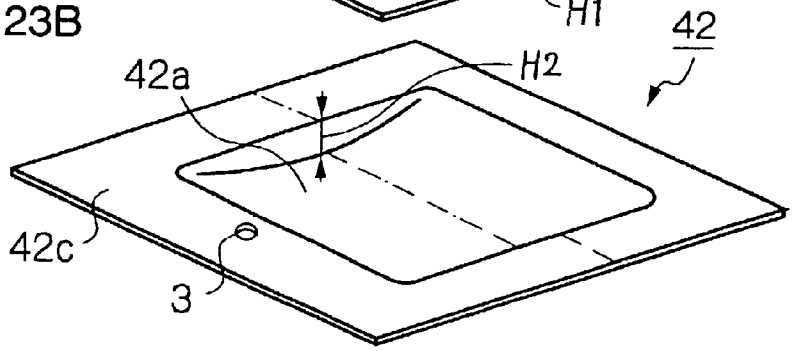

FIGS. 23A, 23B, 23C, and 23D show examples of forming blanks in three-dimensional shapes beforehand by press stamping or any other suitable method and welding them throughout the whole circumference. FIG. 23A shows a blank ("preformed blank" hereinafter) 41 having a preformed portion 41*a* received within the upper die cavity and also having a protuberance 41*b* adjacent to the preformed portion 41*a* and received within the channel-forming groove 10*d*. FIG. 23B shows a preformed blank 42 having a preformed portion 42*a* received within the lower die cavity 11*b* and also having a pierced hole 3.

Depths H1 and H2 of the preformed portions 41*a* and 42*a*, respectively, may be set appropriately in conformity with the shape of a hydroformed product to be obtained. Another part may be bonded to a predetermined inside position of each of the preformed portions 41*a* and 42*a* by a suitable method such as, for example, welding, adhesion, or brazing.

Figure 23C:
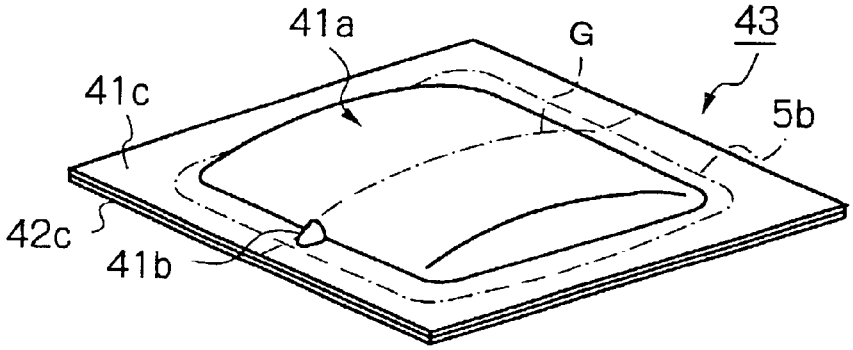

FIG. 23C shows a double sheet blank ("preformed double sheet blank" hereinafter) 43 obtained by superimposing the preformed blanks 41 and 42 one on the other and laser-welding flanges 41*c* and 42*c* along a line 5*b*. As shown in FIG. 10C, the bonding may be done by adhesion or brazing. After the superimposition of both blanks, the vicinity of an edge portion may be partially bonded by, say, spot welding for ease of handling.

Figure 23D:
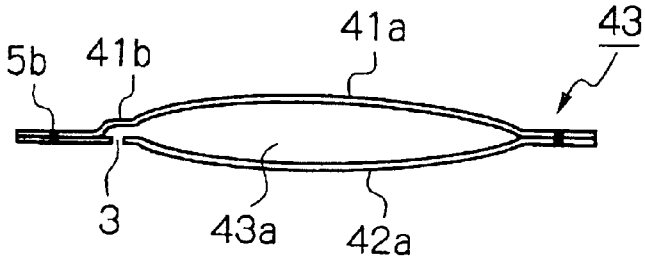

FIG. 23D is a sectional view taken along a dot-dash line G in FIG. 23C. The feed of fluid from the pierced hole 3 to an internal space 43*a* may be done at a low fluid pressure. Since it can be done in a short time, it is possible to shorten the time required for the hydroforming work. Further, since the bulging action in the hydroforming work is applied to the preformed portions 41*a* and 42*a* having respective depths, it is possible to obtain a deeper formed part than in hydroforming flat sheets.

EXAMPLES

Example 1

A cold-rolled steel sheet SPCC (JIS G3141) having a thickness of 0.7 mm and a tensile strength of 320 MPa was cut into such blanks 1 and 2 of a square shape having a one-side length of 600 mm as shown in FIG. 9A.

A pierced hole 3 having a diameter of 16 mm was formed in the blank 2. Both blanks 1 and 2 were put one on the other and laser-welded to afford a double sheet blank 5 having a welded line 5*b* such as that shown in FIG. 10B.

Using upper and lower dies 10, 11 having respective die cavities 10*b* and 11*b* shown in FIG. 11 which die cavities have a planar size of 400 mm square and a depth h1=h2=30 mm, the double sheet blank 5 was clamped with a holding force of 4900 kN. An O-ring (JIS B2406) having a nominal No. P24 was fitted in a circular groove 11*f*, the circular groove 11*f* having an outside diameter of 30 mm, an inside diameter D of 20.6 mm, and a depth of 2.7 mm, to provide a seal between the pierced hole 3 and a thru-hole 11*d* formed in the lower die and having an inside diameter of 8 mm.

Then, the pressure of fluid (water emulsion) introduced into the pierced hole 3 from the thru-hole 11*d* was raised to 9.8 MPa to push up the blank 1 locally into a channel-forming groove 10*d* having a width w of 10 mm and a depth h of 2 mm, as shown in FIG. 12B, allowing the fluid to be introduced between the blanks 1 and 2 and thereby causing the blanks 1 and 2 to bulge into the die cavities 10*b* and 11*b* respectively. The fluid pressure was finally increased to 29.4 MPa and the bulging work was finished. Keeping the pressure of the medium, a punch 12 built into the lower die 11, as shown in FIG. 15B, was moved to pierce a thru-hole 52 having a planar size of 30 mm square without separation of slug 51 and the pressure of the medium was decreased. Thereafter, the fluid was discharged from the punched thru-hole 52 to get the stretch formed part 30*a* shown in FIG. 17A. Then, by the method shown in FIG. 18, the flange 5*a* was cut off along the trimming line 25*c* located outside the welded line 5*b*1 of the formed part to obtain a product.

Example 2

An aluminum sheet A1100P (JIS H4000) having a thickness of 1 mm and a tensile strength of 95 MPa was cut into such a square blank 1 having a one-side length of 600 mm as shown in FIG. 9A. From the same aluminum sheet was also cut out a blank 2 of the same size as the blank 1, the blank 2 having a pierced hole 3 with a diameter of 16 mm. The blank 2, which was coated with an epoxy resin-based adhesive in a hatched area shown in FIG. 10C, was superimposed on the blank 1, followed by thermocompression bonding at 150° C., to fabricate a double sheet blank 7 in which the adhesive was hardened.

Using upper and lower dies 10, 11 having respective die cavities 10*b* and 11*b* shown in FIG. 11, the die cavities 10*b* and 11*b* having a planar size of 400 mm square and a depth of h1=h2=30 mm, the double sheet blank 7 was clamped with a holding force of 2450 kN.

An O-ring (JIS B2406) having a nominal No. P24 was fitted in a circular groove 11*f*, the circular groove 11*f* having an outside diameter of 30 mm, an inside diameter D=20.6 mm, and a depth of 2.7 mm, to provide a seal between the pierced hole 3 and a thru-hole 11*d* formed in the lower die and having an inside diameter of 8 mm. The pressure of fluid (water emulsion) which has filled into the pieced hole 3 through the thru-hole 11*d* was raised to 4.9 MPa to push up the blank 1 locally into such a channel-forming groove 10*d* having a width w=10 mm and a depth h=2 mm as shown in FIG. 12B, allowing the fluid to be introduced between the mating surfaces of both blanks 1 and 2 and thereby causing both blanks to bulge into the die cavities 10*b* and 11*b* respectively. The fluid pressure was finally increased to 14.7

MPa and the bulging work was finished. Keeping the pressure of the medium a punch 12 built into the lower die 11 was moved to pierce, a thru-hole 52 having a planar size of 30 mm square without separation of slug 51, as shown in FIG. 15B, and the pressure of the medium was decreased. Thereafter, the fluid was discharged from the punched thru-hole 52, to get the stretch formed part 30*b* shown in FIG. 17B. Thereafter, the flange 7*a* of this formed part was cut off along the trimming line 25*c* by the method shown in FIG. 18 to obtain a product.

Example 3

A cold-rolled steel sheet SPCC (JIS G3141) having a thickness of 0.6 mm and a tensile strength of 320 MPa was cut into a square blank 1 having a one-side length of 600 mm, which is shown in FIG. 22A. Likewise, a cold-rolled steel sheet SPCC (JIS G3141) having a thickness of 0.8 mm and a tensile strength of 310 MPa was cut into a blank 2. The blank 2 was formed with a protuberance 2*a* having a diameter of 30 mm and a depth of 3 mm and a pierced hole 3 formed in a bottom of the protuberance 2*a*, the pierced hole 3 having a diameter of 16 mm.

The blanks 1 and 2 were superimposed together and laser-welded to make a double sheet blank 5 having a welded line 5*b*, which is shown in FIG. 10B. As shown in FIG. 11, the double sheet blank 5 was clamped with a clamping force of 6860 kN by means of upper and lower dies 10, 11 having die cavities 10*b* and 11*b* respectively, the die cavities 10*b* and 11*b* having a planar size of 400 mm square and a depth of h1=h2=30 mm. An O-ring (JIS B 2406) having a nominal No. P24 was fitted in a circular groove 11*f* having an outside diameter of 30 mm, an inside diameter D of 20.6 mm and a depth of 2.7 mm to provide a seal between the pierced hole 3 and a thru-hole 11*d* having an inside diameter of 8 mm. The pressure of fluid (water emulsion) which has filled the pierced hole 3 through the thru-hole 11*d* was raised to 9.8 MPa to push up the blank 1 locally into a channel-forming groove 10*d* shown in FIG. 12B, the channel-forming groove 10*d* having a width w of 10 mm and a depth h of 2 mm, allowing the fluid to enter between both blanks 1 and 2 and thereby causing both blanks to bulge into the die cavities 10*b* and 11*b* respectively. The fluid pressure was finally increased to 39.2 MPa and the bulging work was finished.

Keeping the pressure of the medium, a punch 12 built into the lower die 11, as shown in FIG. 15B, was moved to pierce a thru-hole 52 having a planar size of 30 mm square without separation of slug 51, and the pressure of the medium was decreased. Thereafter, the fluid was discharged from the thru-hole 52 to get a stretch formed part 30*a* shown in FIG. 17A. Thereafter, by the method shown in FIG. 18, a flange 5*a* was cut off along a trimming line 25*c* located outside a welded line 5*b*1 of the stretch formed part to obtain a product.

Example 4

A cold-rolled steel sheet SPCC (JIS G3141) having a thickness of 0.7 mm and a tensile strength of 320 MPa was cut into a square blank 1 having a one-side length of 600 mm, which is shown in FIG. 9A. Likewise, from the same cold-rolled steel sheet was cut out a blank 2 of the same size as the blank 1 and a pierced hole 3 having a diameter of 16 mm was formed in the blank 2. Both blanks 1 and 2 were then put one on the other and spot-welded at four corner portions to fabricate a double sheet blank.

Then, using upper and lower dies 10 and 11 respectively having such die cavities 10*b* and 11*b* as shown in FIG. 11 and each having a bead 10*g* and a bead groove 11*g* throughout the whole circumference, the die cavities 10*b* and 11*b* having a planar size of 400 mm square and a depth of h1=h2=30 mm, the double sheet blank, indicated at 5, was clamped with a clamping force of 4900 kN.

An O-ring (JIS B2406) having a nominal No. P24 was fitted in a circular groove 11*f* having an outside diameter of 30 mm, an inside diameter D of 20.6 mm and a depth of 2.7 mm to provide a seal between the pierced hole 3 and a thru-hole 11*d* formed in the lower die and having an inside diameter of 8 mm. Then, the pressure of fluid (water emulsion) which has filled the pierced hole 3 from the thru-hole 11*d* was raised to 9.8 MPa to push up the blank 1 locally into such a channel-forming groove 10*d* having a width w of 10 mm and a depth h of 2 mm as shown in FIG. 12B, allowing the fluid to be introduced between both blanks 1 and 2 and thereby causing both blanks to bulge respectively into the die cavities 10*b* and 11*b*. The fluid pressure was finally increased to 29.4 MPa and the bulging work was finished.

Keeping the pressure of the medium, a punch 12 built into the lower die 11 was moved to pierce a thru-hole 52 having a planar size of 30 mm square while separating slug 51 and the pressure of the medium was decreased. Thereafter, the fluid was discharged from the thru-hole 52 to get a stretch formed part 30*a* shown in FIG. 17A. Thereafter, a flange 5*a* of this stretch formed part was cut to cut off the spot-welded portion, to obtain two upper and lower stretch formed parts.

Example 5

A cold-rolled steel sheet SPCC (JIS G3141) having a thickness of 0.7 mm and a tensile strength of 320 MPa was cut into a square blank having a one-side length of 600 mm. This square blank was then subjected to press stamping into such a preformed blank 41 as shown in FIG. 23A, the preformed blank 41 having a preformed portion 41*a* with a depth H1 of 20 mm and also having a protuberance 41*b*. Likewise, from the same cold-rolled steel sheet was cut out a square blank having a one-side length of 600 mm. This square blank was then subjected to press stamping to form a preformed portion 42*a* having a depth H2 of 20 mm, as shown in FIG. 23B. Further, a pierced hole 3 having a diameter of 16 mm was formed in the same blank to obtain a preformed blank 42.

Both preformed blanks 41 and 42 were then put one on the other and laser-welded to fabricate a preformed double sheet blank 43 having a bonded line 5*b* shown in FIG. 23C.

Then, using upper and lower dies 10, 11 respectively having such die cavities 10*b* and 11*b* as shown in FIG. 11, the die cavities 10*b* and 11*b* having a planar size of 400 mm square and a depth of h1=h2=40 mm, the double sheet blank 5 was clamped with a clamping force of 4900 kN.

An O-ring (JIS B2406) having a nominal No. P24 was fitted in a circular groove 11*f* having an outside diameter of 30 mm, an inside diameter D of 20.6 mm and a depth of 2.7 mm to provide a seal between the pierced hole 3 and a thru-hole 11*d* formed in the lower die and having an inside diameter of 8 mm. An internal space 43*a* of the preformed double sheet blank was filled with fluid (water emulsion) introduced from the thru-hole 11*d*. Then, the fluid pressure was increased to 29.4 MPa and the bulging work within the die cavities 10*b* and 11*b* was finished.

Keeping the pressure of the medium, a punch 12 built into the lower die 11 was moved to pierce a thru-hole 52 having a planar size of 30 mm square without separation of slug 51, as shown in FIG. 15B, and the pressure of the medium was decreased. Thereafter, the fluid was discharged from the punched thru-hole 52 to get a stretch formed part 30*a* shown in FIG. 17A. Then, by the method shown in FIG. 18, a flange was cut off along a trimming line 25*c* located outside a welded line 5*b*1 of the stretch formed part to obtain a product.

Example 6

A square blank 1 shown in FIG. 9A, the blank 1 having a one-side length of 600 mm and obtained by cutting a cold-rolled steel sheet SPCC (JIS G3141) having a thickness of 0.7 mm and a tensile strength of 320 MPa, and a blank 2 of the same material and size as the blank 1, the blank 2 having a pierced hole 3 with a diameter of 10 mm, were put one on the other and spot-welded at four corners to facilitate handling, affording a double sheet blank 4 shown in FIG. 10A.

Then, the flange 5*a* of the double sheet blank 4 was clamped using upper and lower dies 10, 11 respectively having such die cavities 10*b* and 11*b* as shown in FIG. 11 and having a bead 10*b* and a bead groove 11*g* throughout the whole circumference around the die cavities, the die cavities 10*b* and 11*b* having a planar size of 400 mm square, a curvature radius of respective bottoms 10*h* and 11*h* of 3000 mm and a depth of h1=h2=40 mm.

Then, an O-ring (JIS B2406) having a nominal No. P16 was fitted in a circular groove 11*f* having an outside diameter of 20 mm, an inside diameter D of 13.6 mm and a depth of 2 mm to provide a seal between the pierced hole 3 and a thru-hole 11*d* formed in the lower die and having an inside diameter of 8 mm. The pressure of the pressurized medium (water emulsion) which has filled the pierced hole 3 from the thru-hole 11*d* was raised to 9.8 MPa to push up the blank 1 locally into a channel-forming groove 10*d* shown in FIG. 12B, the channel-forming groove 10*d* having a width w of 13 mm and a depth h of 4 mm, allowing a pressurized medium to be introduced between both blanks 1 and 2 and thereby causing both blanks to bulge into the die cavities 10*b* and 11*b* respectively.

The pressure of the pressurized medium was finally increased to 29.4 MPa, causing both blanks to contact the whole areas of the die cavity bottoms 10*h* and 11*h*. At this time, the amount of movement of the flange 5*a* toward the die cavities was 3 mm at most. Thereafter, the pressure of the pressurized medium was decreased and the stretch formed part 30 shown in FIG. 16A was taken out from the dies, the medium was discharged from the pierced hole 3, and the flange 5*a* of the formed part 30 was cut off along a trimming line 25*c* located inside the bead pattern 25*e* to obtain two panel parts 31 and 32 shown in FIGS. 16B and 16C respectively.

An equivalent strain of panel surfaces 25*a* and 26*a* of the panel parts 31 and 32 was 4%. Central portions of the panel surfaces 25*a* and 26*a* were checked for dent resistance by the foregoing method to find that the dent resistance load was 196 N.

Figure 1A:
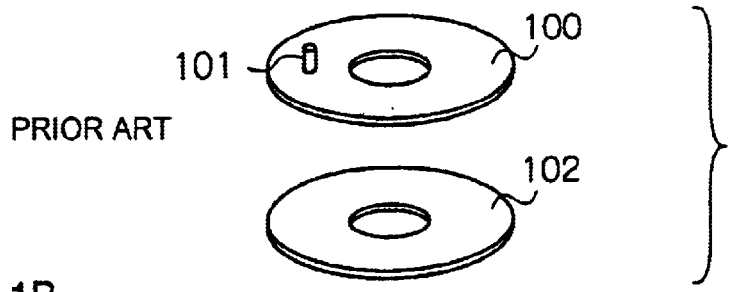
Figure 1B:
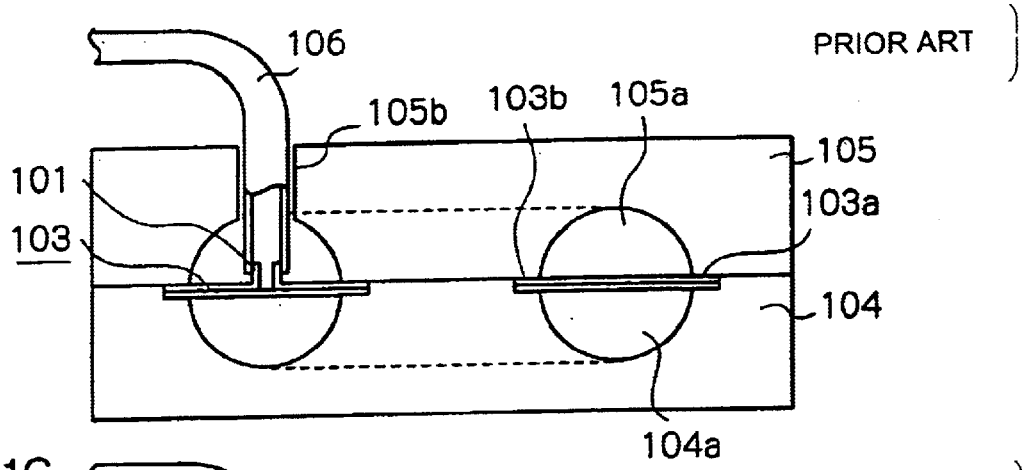
Figure 1C:
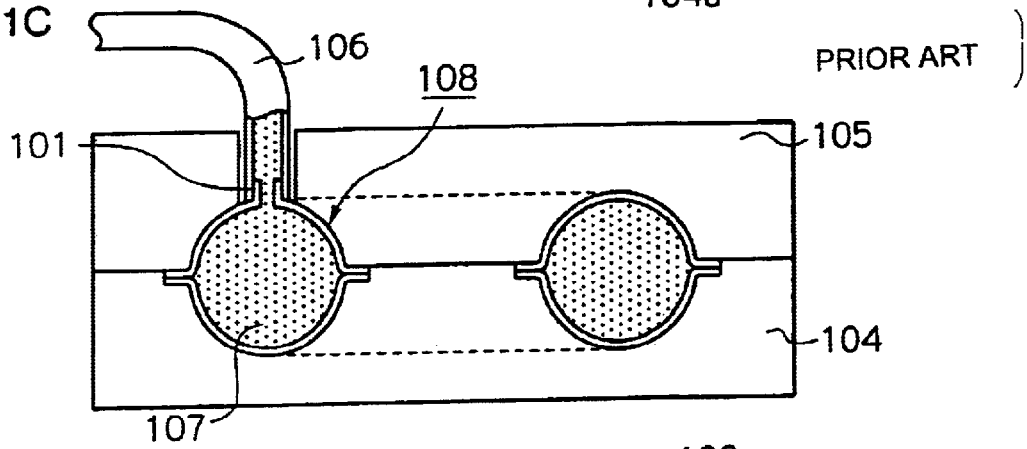
Figure 1D:
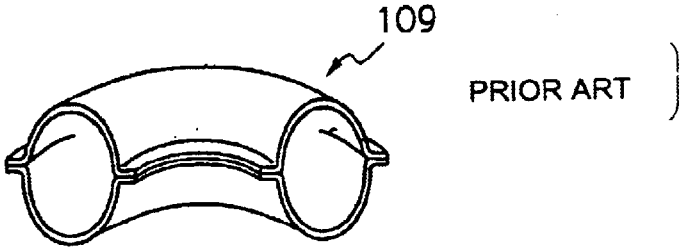
Figure 2A:
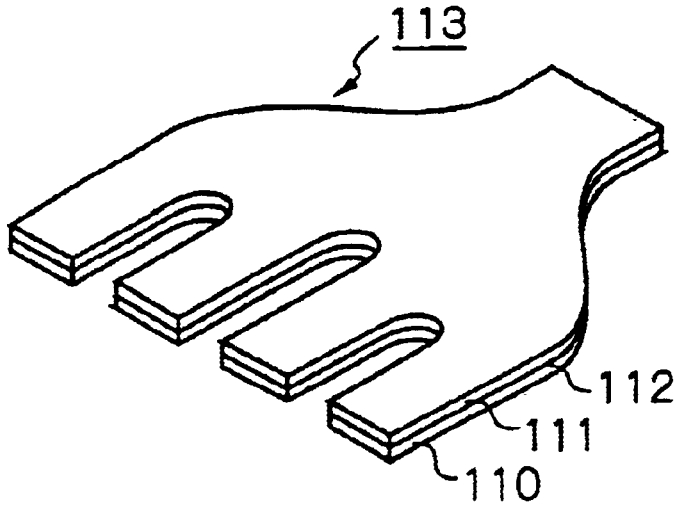
Figure 2B:
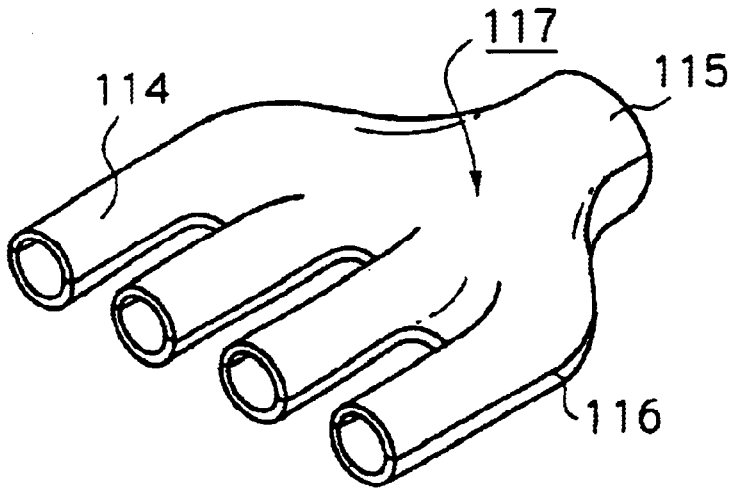
PRIOR ART FIG. 2B
Figure 3A:
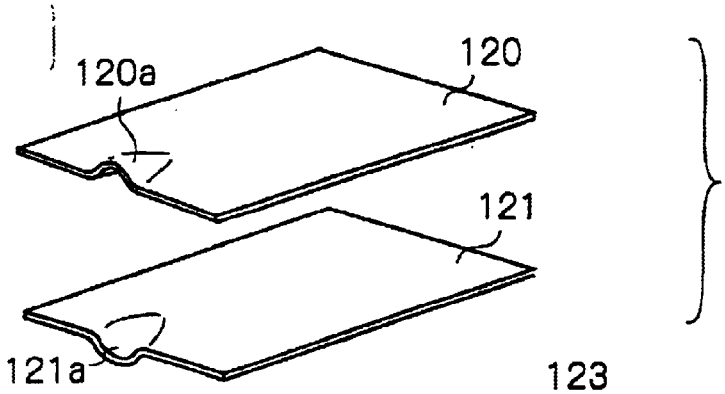
FIG. 3A PRIOR ART
Figure 3B:
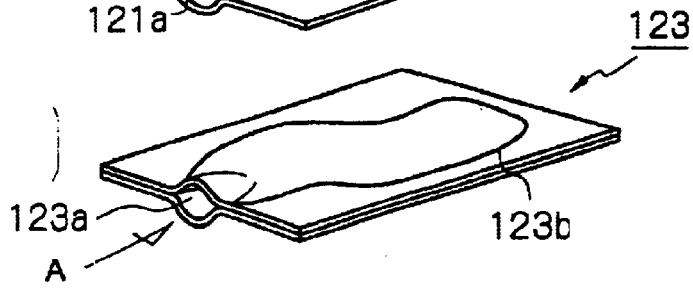
FIG. 3B PRIOR ART
Figure 3C:
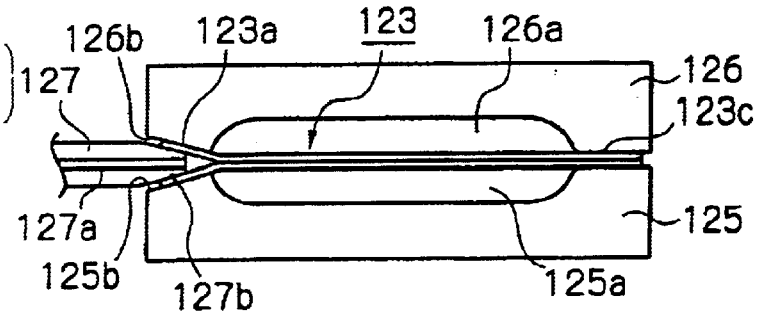
FIG. 3C PRIOR ART
Figure 3D:
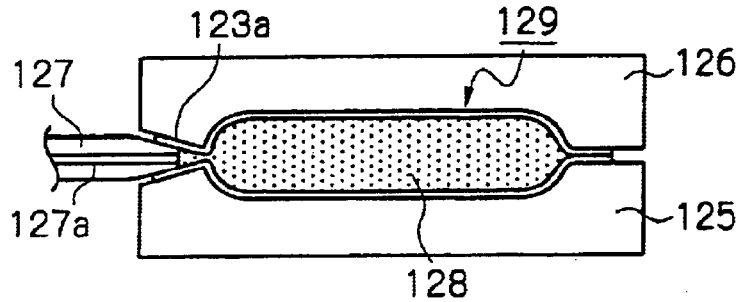
FIG. 3D PRIOR ART
Figure 3E:
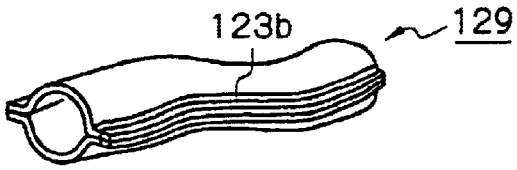
FIG. 3E PRIOR ART
Figure 4:
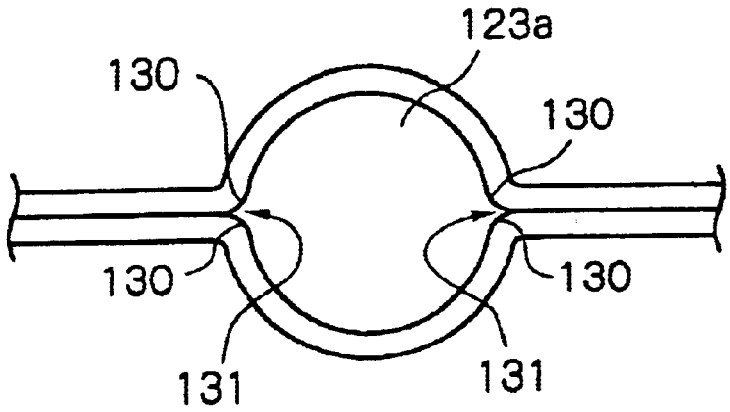
FIG. 4 PRIOR ART
FIG. 4 is a front view of FIG. 3B as seen in the direction of arrow A.
Figure 5A:
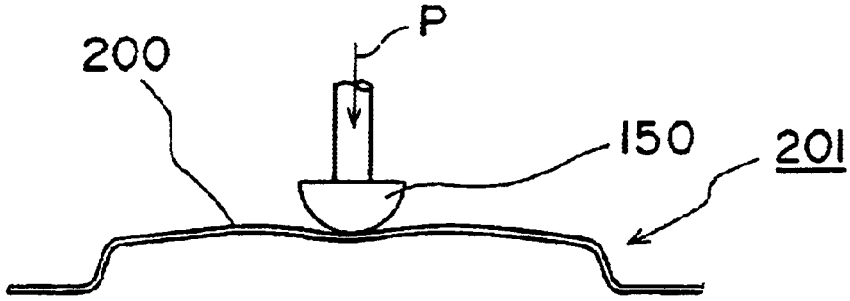
FIG. 5A PRIOR ART
Figure 5B:
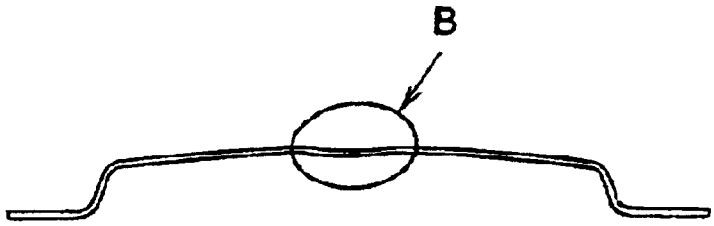
FIG. 5B PRIOR ART
Figure 5C:
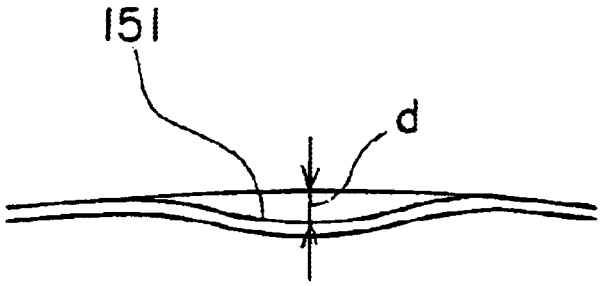
FIG. 5C PRIOR ART
Figure 6:
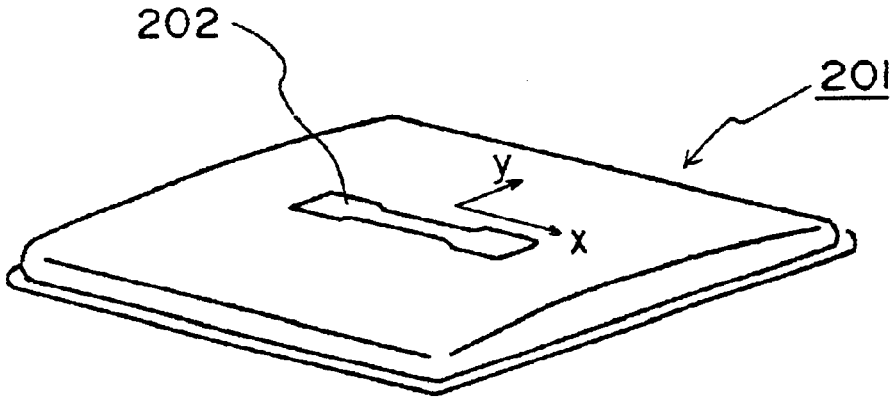
FIG. 6 PRIOR ART
FIG. 6 is a diagram for explaining in what state a tensile specimen is sampled from a stretch formed portion, or panel surface.
Figure 7:
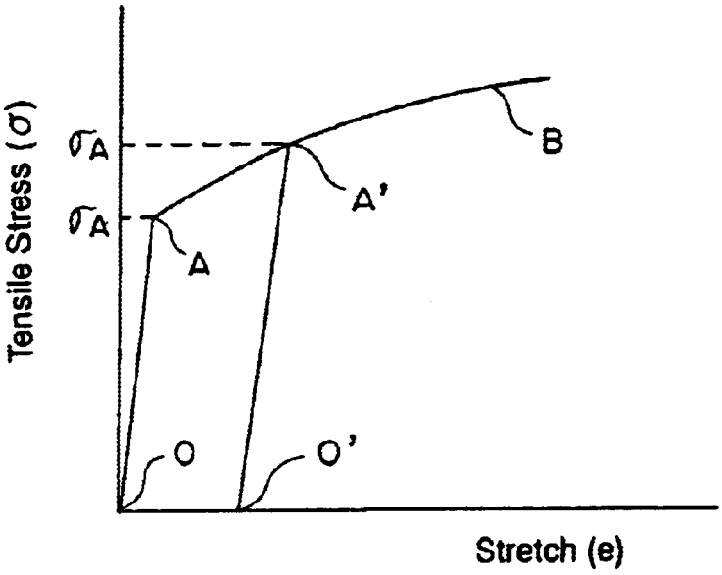
FIG. 7 PRIOR ART
FIG. 7 is a schematic diagram for explaining a stress-strain relation in a tension test.
Figure 8A:
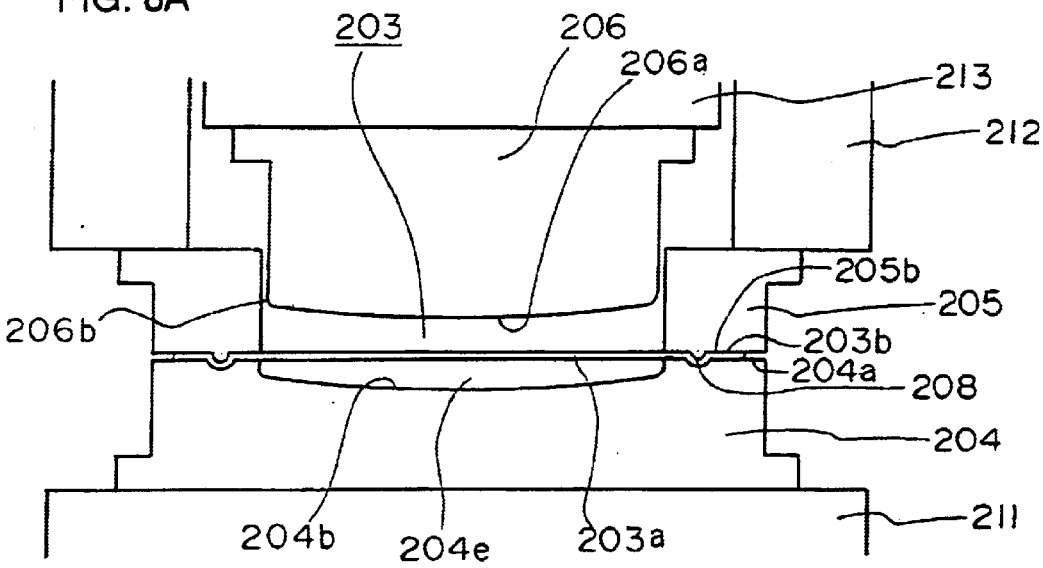
FIG. 8A PRIOR ART
Figure 8B:
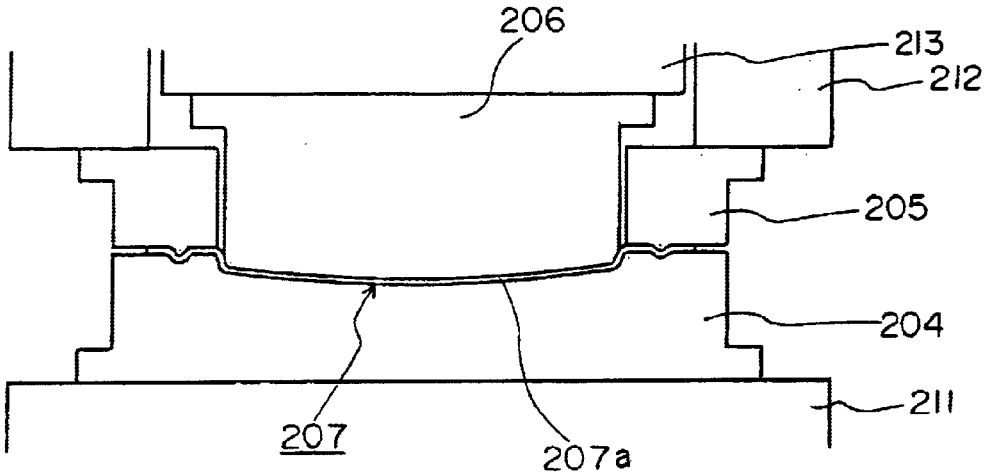
FIG. 8B PRIOR ART
Figure 8C:
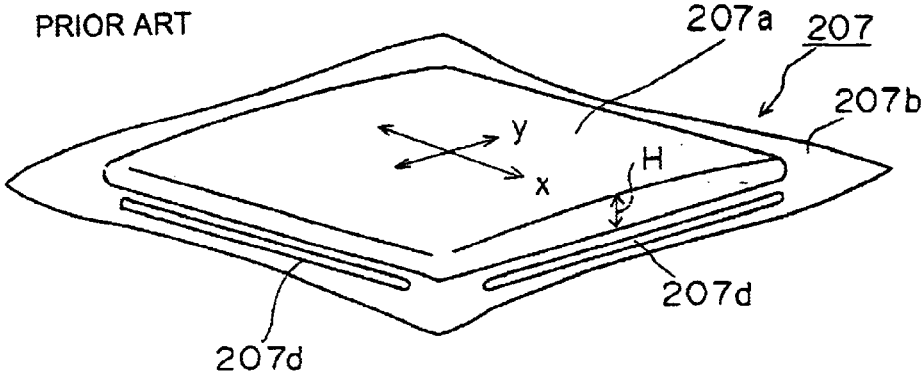
FIG. 8C PRIOR ART

On the other hand, the blank 1 was press-stamped into the same shape as the panel surfaces 25*a* and 26*a* by the method illustrated in FIGS. 8A, 8B, and 8C. An equivalent strain of a panel surface 207*a* of a formed part 207 was 1.5%. A flange 207*b* was cut off in the same manner as for the panel parts 31 and 32 and a central portion of the panel surface 107*a* was checked for dent resistance by the foregoing method to find that the dent resistance load was 108 N. For obtaining a dent resistance load of 196 N by press-stamping a steel sheet of the same strength it was necessary to set the sheet thickness at 1 mm.

Thus, according to the present invention, in comparison with the conventional press forming method, the dent resistance can be improved to about 1.8 times using the same sheet blank, and the blank thickness required for attaining the same dent resistance as in the press forming method can be decreased, thereby permitting the reduction in weight of the resulting panel parts.

Example 7

As shown in FIG. 22A, a square blank 1 having a one-side length of 600 mm and obtained by cutting a cold-rolled steel sheet SPCC (JIS G3141) having a thickness of 0.8 mm and a tensile strength of 330 MPa, and a blank 2 of the same material and size as the blank 1, the blank 2 having two protuberances 2*a* each formed with a pierced hole 3 of 10 mm in diameter, the protuberances 2*a* being each 20 mm in diameter and 3.2 mm in depth, were put one on the other and laser-welded along a closed curve as shown in FIG. 10B to fabricate a double sheet blank 5 of bonded blanks.

A flange of the double sheet blank 5 was clamped with upper and lower dies having respectively such upper and lower die cavities 10*b*, 11*b* as shown in FIG. 11 and having a bead 10*g* and a bead groove 11*g* throughout the whole circumference around the upper and lower die cavities, the die cavities 10*b* and 11*b* having a planar size of 400 mm square, a curvature radius of 3000 mm at respective bottoms 10*h* and 11*h*, and a depth of h1=h2=60 mm, with two recesses 11*j* formed in the lower die 11, the recesses 11*j* being shown in FIG. 22B and having a diameter of 20.2 mm and a depth of 3 mm.

An O-ring (JIS B2406) having a nominal No. P16 was used to provide a seal between the two protuberances 2*a* and a thru-hole 11*d* having an inside diameter of 8 mm and the pressure of pressurized medium (water emulsion) which has been introduced from the thru-hole 11*d* formed in the lower die was raised to 9.8 MPa to push up the blank 1 locally into a channel-forming groove 10*d* shown in FIG. 22C and having a width w of 13 mm and a depth h of 4 mm, allowing the pressurized medium to enter between both blanks 1 and 2 and thereby causing both blanks to bulge into the die cavities 10*b* and 11*b*.

The pressure of the pressurized medium was finally increased to 39.2 MPa, causing both blanks 1 and 2 to contact the whole areas of the die cavity bottoms 10*h* and 11*h*. At this time, the amount of movement of the flange 6*a* toward the die cavities was 3 mm in the vicinity of the pierced holes 3 and a maximum of 10 mm at the other portion. Thereafter, the pressure of the pressurized medium was decreased and the formed part 30 shown in FIG. 16A was taken out from the dies, further, the pressurized medium was discharged from the two pierced holes 3 and the flange of the formed part 30 was cut off along the trimming line 25*c* located inside the bead pattern 25*e* to afford two panel parts 31 and 32 shown in FIGS. 16B and 16C.

An equivalent strain of panel surfaces 25*a* and 26*a* of the panel parts 31 and 32 was 10% and central portions of the panel surfaces 25*a* and 26*a* were checked for dent resistance by the foregoing method to find that the dent resistance load was 304 N.

On the other hand, the blank 1 was press-stamped into the same shape as the panel surfaces 25*a* and 26*a* by the method illustrated in FIGS. 8A, 8B, and 8C. An equivalent strain of a panel surface 207*a* of a formed part 207 was 1.8%. A flange 207*b* was cut off in the same manner as for the panel parts 31 and 32 and a central portion of the panel part 207*a* was checked for dent resistance by the foregoing method to find that the dent resistance load was 147N. Thus, it is seen that according to the present invention, as compared with the conventional press forming method, the dent resistance in using the same sheet blanks can be improved to about 2.1 times.

In all of the methods described in the above Examples 1 to 7 the leakage of pressurized medium did not occur during the hydroforming process and the hydroforming work can be done efficiently to afford desired formed products.

For bonding two blanks together there may be adopted a method wherein both blanks are bonded together by laser welding continuously along a loop-like bonded line, or a method wherein both blanks are surface-bonded together in respective peripheral areas by adhesion or brazing, or a method wherein both blanks are bonded together in a discontinuous manner by spot welding. It is also possible to effect the hydroforming work without causing leakage of fluid in a merely superimposed state of two blanks without bonding.

Further, by adjusting an equivalent strain of panel surface to a value falling under an appropriate range it is possible to improve the dent resistance and reduce the blank thickness required for attaining the same dent resistance as in the press stamping method, thus proving that the weight of panel part can be reduced.

According to the sheet hydroforming method using the forming die of the present invention, as set forth above, at the time of stretch-forming two metallic sheet blanks, pressurized medium can be introduced between the mating surfaces of the blanks easily without causing leakage of the pressurized medium. By adjusting an equivalent strain of stretch formed portion to a value falling under an appropriate range it is possible to improve the dent resistance and make a contribution to the reduction in weight of panel part. Thus, the present invention brings about an outstanding effect industrially.

What is claimed is:

1. A metallic sheet hydroforming method comprising:

clamping two stacked metallic sheets between holding surfaces of a pair of upper and lower dies respectively having die cavities of the same inner contour shape as an outer contour shape of product;

forming a thru-hole for introducing a fluid in one of said dies, said thru-hole leading to the holding surface of the one die;

positioning a pierced hole for introducing the fluid with said thru-hole, said pierced hole being formed in one of said metallic sheets in a portion of the one metallic sheet which portion is in contact with the holding surface of the one die; and introducing said fluid in a pressurized state between mating surfaces of said two stacked metallic sheets through the pierced hole from the thru-hole, thereby causing the metallic sheets to be stretch formed into an internal space defined by said die cavities;

wherein an O-ring is recessed into a circular groove around the thru-hole positioned with the holding surface, the O-ring being elastically deformed with the pressing force which works between the holding surface and one of the metallic sheets thereby preventing the pressurized fluid between said holding surface and said one metallic sheet from leaking.

2. A metallic sheet hydroforming method according to claim 1, wherein said two stacked metallic sheets are bonded together at their mating surfaces located in an area outside a portion to be stretch formed and outside said pierced hole.

3. A metallic sheet hydroforming method according to claim 1, wherein after said metallic sheets have been stretch formed by introducing the pressurized fluid between the mating surfaces of the metallic sheets, portions of the metallic sheets which portions are not necessary as products and which portions are respectively in contact with the holding surfaces of said dies, are cut off to obtain two formed parts at a time.

4. A metallic sheet hydroforming method according to claim 1, wherein a portion(s) to be stretch formed of one or both of said metallic sheets is (are) formed in a three-dimensional shape beforehand.

5. A metallic sheet hydroforming method according to claim 1, wherein after said metallic sheets have been stretch formed, one or both stretch formed portion(s) is (are) punched to form a hole(s) therein with use of a punch(es) built into one or both of said dies, allowing the fluid to be discharged from said hole(s).

6. A metallic sheet hydroforming method according to claim 1, wherein an equivalent strain of a stretch formed portion of a formed part obtained by stretch forming each said metallic sheet is in the range of 2% to 10%.

7. A metallic sheet hydroforming method according to claim 2, wherein after said metallic sheets have been stretch formed by introducing the pressurized fluid between the mating surfaces of the metallic sheets, portions of the metallic sheets which portions are not necessary as products and which portions are respectively in contact with the holding surfaces of said dies, are cut off to obtain two formed parts at a time.

8. A metallic sheet hydroforming method according to claim 3, wherein a portion(s) to be stretch formed of one or both of said metallic sheets is (are) formed in a three-dimensional shape beforehand.

9. A metallic sheet hydroforming method according to claim 4, wherein a portion(s) to be stretch formed of one or both of said metallic sheets is (are) formed in a three dimensional shape beforehand.

10. A metallic sheet hydroforming method according to claim 2, wherein after said metallic sheets have been stretch formed, one or both stretch formed portion(s) is (are) punched to form a hole(s) therein with use of a punch(es) built into one or both of said dies, allowing the fluid to be discharged from said hole(s).

11. A metallic sheet hydroforming method according to claim 3, wherein after said metallic sheets have been stretch formed, one or both stretch formed portion(s) is (are) punched to form a hole(s) therein with use of a punch(es) built into one or both of said dies, allowing the fluid to be discharged from said hole(s).

12. A metallic sheet hydroforming method according to claim 4, wherein after said metallic sheets have been stretch formed, one or both stretch formed portion(s) is (are) punched to form a hole(s) therein with use of a punch(es) built into one or both of said dies, allowing the fluid to be discharged from said hole(s).

13. A metallic sheet hydroforming method according to claim 2, wherein an equivalent strain of a stretch formed portion of a formed part obtained by stretch forming each said metallic sheet is in the range of 2% to 10%.

14. A metallic sheet hydroforming method according to claim 3, wherein an equivalent strain of a stretch formed portion of a formed part obtained be stretch forming each said metallic sheet is in the range of 2% to 10%.

15. A metallic sheet hydroforming method according to claim 4, wherein an equivalent strain of a stretch formed portion of a formed part obtained by stretch forming each said metallic sheet is in the range of 2% to 10%.

16. A metallic sheet hydroforming method according to claim 5, wherein an equivalent strain of a stretch formed portion of a formed part obtained by stretch forming each said metallic sheet is in the range of 2% to 10%.

* * * * *

UNITED STATES PATENT AND TRADEMARK OFFICE

CERTIFICATE OF CORRECTION

PATENT NO. : 6,722,009 B2
DATED : April 20, 2004
INVENTOR(S) : Masayasu Kojima et al.

It is certified that error appears in the above-identified patent and that said Letters Patent is hereby corrected as shown below:

Column 25,
Line 1, "...obtained be stretch…" should be -- ...obtained by stretch… --

Signed and Sealed this

Sixteenth Day of November, 2004

JON W. DUDAS
*Director of the United States Patent and Trademark Office*